US009403609B2

(12) United States Patent
Bonifazi et al.

(10) Patent No.: US 9,403,609 B2
(45) Date of Patent: Aug. 2, 2016

(54) MOBILE STRAPPING DEVICE

(71) Applicant: SIAT. S.p.a., Turate (IT)

(72) Inventors: Antonio Bonifazi, Cornaredo (IT); Ludmil Tchavdarov, Bovisio Masciago (IT); Nicola Izzo, Novate Milanese (IT)

(73) Assignee: SIAT S.P.A., Turate (IT)

( * ) Notice: Subject to any disclaimer, the term of this patent is extended or adjusted under 35 U.S.C. 154(b) by 675 days.

(21) Appl. No.: 13/652,628

(22) Filed: Oct. 16, 2012

(65) Prior Publication Data

US 2014/0083311 A1 Mar. 27, 2014

(30) Foreign Application Priority Data

Sep. 24, 2012 (EP) ..... 12185739

(51) Int. Cl.

| | |
|---|---|
| ***B65B 13/32*** | (2006.01) |
| ***B65B 13/22*** | (2006.01) |
| ***B65B 13/02*** | (2006.01) |
| ***B65B 13/18*** | (2006.01) |

(52) U.S. Cl.

CPC ..... *B65B 13/025* (2013.01); *B65B 13/185* (2013.01); *B65B 13/187* (2013.01); *B65B 13/22* (2013.01); *B65B 13/327* (2013.01)

(58) Field of Classification Search

CPC .. B65B 13/025; B65B 13/322; B65B 13/327; B65B 13/22; B65B 13/185; B65B 13/187; B65B 13/24; B65B 13/305

USPC ..... 100/4, 29, 32, 33 PB; 140/93.2

See application file for complete search history.

(56) References Cited

U.S. PATENT DOCUMENTS

| | | | | |
|---|---|---|---|---|
| 2,936,156 | A | 5/1960 | Coupland | |
| 3,028,885 | A | 4/1962 | Leslie et al. | |
| 4,282,907 | A * | 8/1981 | Massion et al. | 140/93.4 |
| 4,934,261 | A * | 6/1990 | Niedrig | B65B 13/327 100/32 |
| 5,653,095 | A * | 8/1997 | Stamm | B65B 13/327 100/32 |
| 5,954,899 | A * | 9/1999 | Figiel et al. | 156/73.5 |
| 6,328,087 | B1 * | 12/2001 | Finzo et al. | 156/494 |
| 2003/0230058 | A1 * | 12/2003 | Nix | 53/582 |
| 2009/0013656 | A1 * | 1/2009 | Nasiatka | B65B 13/025 53/582 |
| 2011/0056392 | A1 | 3/2011 | Neeser et al. | |

OTHER PUBLICATIONS

European Office Action Application No. 12185739.5, Mar. 25, 2015, 3 pgs.

* cited by examiner

*Primary Examiner* — Jimmy T Nguyen
(74) *Attorney, Agent, or Firm* — Young & Thompson

(57) ABSTRACT

A mobile strapping device for strapping goods with a strap is provided. The mobile strapping device applies a tension to a loop of the strap. The mobile strapping device further provides a connection in the strap for forming a closed loop of the strap. The mobile strapping device further includes a chargeable energy storage for supplying energy. The mobile strapping device further includes a tensioning wheel (5) having an outer circumferential surface and being rotatably drivable about its rotational axis by a drive and a tensioning element (25) having a surface which faces the outer circumferential surface of the tensioning wheel (5). The tensioning wheel (5) is pivotable about a pivot axis (26) which is parallel to and offset from the rotational axis of the tensioning wheel (5).

18 Claims, 15 Drawing Sheets

MOBILE STRAPPING DEVICE

The invention relates to a mobile strapping device for strapping goods with a strap. In particular, the invention concerns a mobile strapping device which comprises a tensioning means for applying a tension to a loop of a strap and a connecting means for providing a connection in said strap for forming a closed loop.

Strapping devices for strapping goods with a strap comprising a tensioning means and a connecting means are known in the prior art. Such known strapping devices use a plastic strap which is inserted into the strapping device in a layered fashion, wherein the strapping device includes a mechanism for moving one of the strap portions positioned on top of the other of the strap portions in a longitudinal direction of the strap, thereby decreasing the length of the loop formed by the strap. Moreover, the known strapping devices can apply a tension to the loop in order to hold packaged goods together or to keep boxes closed to which such a strapping is applied.

Moreover, known strapping devices include a system for connecting the strap in two areas in order to maintain the tensioned condition of the strap. The strap which is not part of the loop for strapping the packaged goods can be cut after connecting such that an appropriate packaging is achieved.

In the prior art, various connecting technologies are possible, including friction welding besides others. In case of friction welding, a friction shoe moving in an oscillating manner is pressed onto the area of two portions of the strap forming a loop. Pressure and heat produced by frictional movement of the friction shoe locally melt the strap which generally contains plastic. After cooling of the melted plastic, a durable connection between the strap portions is created which can only be disconnected by cutting or exceeding a predetermined tension.

It is the object of the present invention to provide a strapping device of the type discussed above with a higher degree of flexibility and an enhanced operation.

According to the present invention, a mobile strapping device for strapping goods with a strap comprises a tensioning means for applying a tension to a loop of said strap, a connecting means for providing a connection in said strap for forming a closed loop of said strap, a chargeable energy storage means and a drive means for driving said tensioning means and said connecting means by energy supplied by said chargeable energy storage means. The tensioning means according to the present invention comprises a tensioning wheel having an outer circumferential surface and being rotatably drivable about its rotational axis by said drive means and a tensioning element having a surface which faces the outer circumferential surface of said tensioning wheel. According to the basic concept of the present invention, said tensioning wheel is pivotable about a pivot axis which is parallel to and offset from said rotational axis of said tensioning wheel.

In the prior art strapping devices, the tensioning wheel is rotatable about an axis which is stationary with respect to the body of the device. Accordingly, in the prior art, the tensioning element which cooperates with the tensioning wheel is movable in order to change the distance between the outer circumferential surface of the tensioning wheel and the surface of the tensioning element.

According to the present invention, the tensioning means follows a new concept according to which the stationary position of the rotational axis of the tensioning wheel is not taken as an inevitable precondition due to the required drive of the tensioning wheel. Rather, according to the present invention, the rotational axis of the tensioning wheel is not stationary, whereas the tensioning element cooperating with the tensioning wheel can be stationary.

According to the invention, a force occurring at the tensioning wheel in an operation of the strapping device can be employed for changing the distance between the outer circumferential surface of the tensioning wheel and the surface of the tensioning member. This advantage is achieved with a mobile strapping device having the movable tensioning wheel as claimed.

According to an embodiment of the present invention, the distance between said outer circumferential surface of said tensioning wheel and said surface of said tensioning element is variable by pivoting said tensioning wheel. Accordingly, the relative movement between the outer circumferential surface of said tensioning wheel and said surface of said tensioning element is achieved by moving said tensioning wheel by pivoting the rotational axis of said tensioning wheel about said pivot axis. Based on such an arrangement, it is not required to move the tensioning element, while the distance between the tensioning wheel and the tensioning element can be adjusted between the position for applying tension to said strap and a position for inserting the strap into a gap between the tensioning wheel and the tensioning element.

According to an embodiment of the present invention, said outer circumferential surface of said tensioning wheel is pulled towards said strap upon applying tension to said loop formed by said strap. According to the basic concept of the present invention, the rotational axis of the tensioning wheel is pivotable such that the distance between the outer circumferential surface of the tensioning wheel and the surface of the tensioning element is variable. This is achieved by providing a sum of a distance between the pivot axis and the rotational axis of the tensioning wheel and the radius of the tensioning wheel with a dimension which is larger than a distance from the pivot axis to the tensioning element. Based on the concept underlying the present invention, the rotation of the tensioning wheel applies a tension to said strap, while a counterforce created by the force for tensioning said strap is present at said rotational axis of the tensioning wheel. According to the arrangement of the present invention, this counterforce changes the pivotable position of the rotational axis of the tensioning wheel resulting in the outer circumferential surface of the tensioning wheel being pulled towards said strap upon applying tension to said loop formed by said strap. Accordingly, the tensioning wheel is automatically pressed against the strap upon applying the tension to the loop formed by the strap.

According to an embodiment of the present invention, a distance between said outer circumferential surface of said tensioning wheel and said surface of said tensioning element is decreased by pivoting said tensioning wheel in a first rotational direction, whereas said tensioning wheel is rotated in a second rotational direction upon applying tension to said loop of said strap, said second rotational direction being opposite to the first rotational direction. According to this embodiment, the rotation of the tensioning wheel creates a moment which pivots the rotational axis of the tensioning wheel in order to decrease the gap between the tensioning wheel and the tensioning element, thus creating pressure acting from said tensioning wheel to said strap positioned on said tensioning element. Consequently, the drive force applied to the tensioning wheel is employed for creating a pressure towards said strap and against said tensioning element.

According to an embodiment of the present invention, a distance between said outer circumferential surface of said tensioning wheel and said surface of said tensioning element is decreased by pivoting said tensioning wheel in a rotational direction, said strapping device comprising a support element which rotatably and pivotably supports said tensioning wheel, wherein a moment is applied in the first rotational direction to said support element upon applying tension to said loop of said strap and rotatably driving said tensioning wheel in a second rotational direction, said second rotational direction being opposite to the first rotational direction. According to the present embodiment, the support element is provided which is pivotably mounted at the pivot axis. The tensioning by the tensioning wheel creates a moment in the support element having the effect to induce a moment to said support element which presses the tensioning wheel to the strap positioned on said tensioning element.

According to an embodiment of the present invention, upon applying tension to said loop formed by said strap, a pressing force between said outer circumferential surface of said tensioning wheel and said surface of said tensioning element is generated based on said moment in said first rotational direction. It follows that the tensioning operation creates a moment which automatically provides the pressing force of the tensioning wheel towards the strap.

According to an embodiment of the present invention, the positional relationship between said pivot axis and said surface of said tensioning element is fixed. It follows that the position of the tensioning element is determined upon the design of the device. The relative movement between the tensioning wheel and the tensioning element is assigned to the tensioning wheel only.

According to an embodiment of the present invention, said tensioning means is arranged for sandwiching and pressing two sections of said strap between said outer circumferential surface of said tensioning wheel and said surface of said tensioning element. Based on such an arrangement, the required tension can be applied to said strap forming a loop wherein two sections of said strap forming a loop are positioned one on top of the other between said tensioning wheel and said tensioning element.

According to an embodiment of the present invention, upon rotatably driving said tensioning wheel, one of said portions of said strap forming said loop contacting said outer circumferential surface of said tensioning wheel is moved longitudinally with respect to the other of said portions of said strap forming said loop contacting said surface of said tensioning element. The strap can be made of a material which allows a sliding movement when arranged one on top of the other. Applying a tensioning force to one of the layered strap portions produces a relative movement of one strap with respect to the other in the longitudinal direction of the strap forming the loop.

According to an embodiment of the present invention, the device further comprises a pivoting mechanism having an operating member, wherein upon operating said operating member, said tensioning wheel is pivotable for moving said outer circumferential surface of said tensioning wheel with respect to said surface of said tensioning member. According to the present embodiment, it is possible to move said tensioning wheel by operating said operating member towards said surface of said tensioning member in order to provide a contact with the outer circumferential surface of the tensioning wheel to the strap positioned between the tensioning wheel and the tensioning element. In this embodiment, it is possible to provide a system for urging the tensioning wheel towards the tensioning element upon releasing the operation member, whereas the operating member is operated in order to move said tensioning wheel away from said tensioning element. Based on the latter arrangement, it is possible to induce the tensioning operation by releasing the operating member such that the tensioning wheel is brought into contact with the strap, such that the rotation of the tensioning wheel will induce the moment for pressing the tensioning wheel to the strap positioned on said tensioning member. Upon releasing said operation member, the movement of said tensioning wheel towards said tensioning member can be performed by an urging means such as a spring.

According to an embodiment of the present invention, said operating member is manually operatable. Due to the fact that the force for pressing said tensioning wheel to said strap is generated automatically upon inducing the tensioning operation by rotating the tensioning wheel, it is possible to improve the operation of the device as the operation for moving the tensioning wheel does not require a manual pressing force to be applied to the operating member. Moreover, it is not required to control the force for operating the operating member as the pressure from the tensioning wheel to the strap is generated automatically and is optimally adjusted.

According to an embodiment of the present invention, the device comprises a control unit, obtaining information regarding a tension applied to said strap upon rotating said tensioning wheel, wherein said control unit is arranged for stopping the rotational drive of said tensioning wheel when said information regarding said tension applied to said strap indicates at least a predetermined tension of said strap. According to this embodiment, the operation for applying tension to said strap can be performed automatically without exceeding the allowable tension. The allowable tension can be set in advance to a predetermined valued depending on the specific application.

According to an embodiment of the present invention, said drive means includes an electric motor, wherein said information regarding said tension applied to said strap includes an electric current supply to said electric motor. The electric current can be easily detected by a predetermined circuit and can be employed for controlling the tension of said strap as there is a specific relationship between the electric current supplied to said electric motor and the torque provided for said tensioning wheel by said electric motor.

According to an embodiment of the present invention, said drive means includes a DC electric motor being drivable in two rotational directions.

According to a further embodiment of the present invention, the device comprises a drive transmission mechanism transmitting a drive torque of said drive means selectively to said tensioning wheel and said connecting means depending on a rotational direction of said drive means. It follows from the embodiment above that it is possible to provide only a single drive means for the device which can be employed for separate operations. Preferably, the tensioning wheel is driven by the electric motor while driving in one direction whereas the connecting means is driven while the electric motor is driven in the other rotational direction. The use of a DC electric motor is a specific advantage as this motor is simple and can be operated in two rotational directions with a known control arrangement.

According to an embodiment of the present invention, said connecting means includes a pressing mechanism pressing two sandwiched portions of said strap by two pressing members, and an oscillating welding mechanism providing a relative oscillating movement of said pressing members generating friction heat in said two sandwiched portions of said strap for friction welding said two portions of said strap. The use of a mechanical friction welding system is useful in mobile applications where energy must be used very efficiently. Consequently, a resistance heating system is not required and the mechanical friction welding system can efficiently use the energy of the chargeable energy storage device, such as a battery, while it is possible to drive the mechanic friction welding system by the same drive means which is used for driving the tensioning means.

According to an embodiment of the present invention, said outer circumferential surface of said tensioning wheel and/or said surface of said tensioning member is provided with friction increasing means adapted to apply a friction to said strap. Preferably, a toothed surface or the like is provided at the outer circumferential surface of the wheel in accordance with the required force to be applied to the strap in a longitudinal direction of the strap. The friction increasing means can include a specific surface property of the outer circumferential surface of the tensioning wheel and/or of the surface of the tensioning member as long as a relative sliding movement of the respective strap which is contact with the outer circumferential surface of the tensioning wheel or the surface of the tensioning member is inhibited. In particular, the friction increasing means has the effect to transmit a force to the surface of the strap.

BRIEF DESCRIPTION OF THE DRAWINGS

The invention will be explained in all detail by way of examples of an embodiment which is illustrated in the following drawings.

Figure 1:
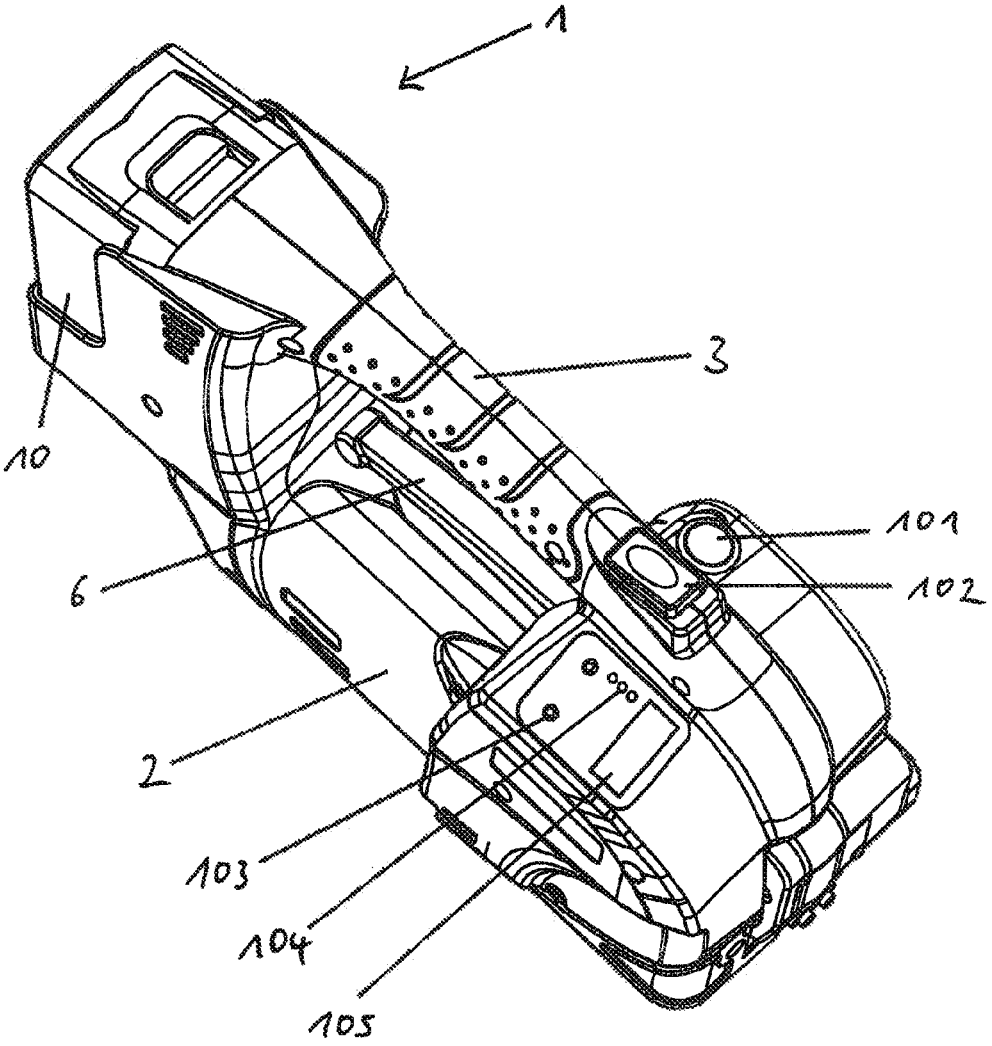
FIG. 1 is a perspective view of a mobile strapping device according to the invention.

In the following, an embodiment of the present invention is explained based on the drawings. It is noted, that the embodiment shown in the drawings is only an example and further modifications of the embodiment within the scope of the invention are possible as discussed below.

EMBODIMENT

Overview and Basic Concept

Figure 2:
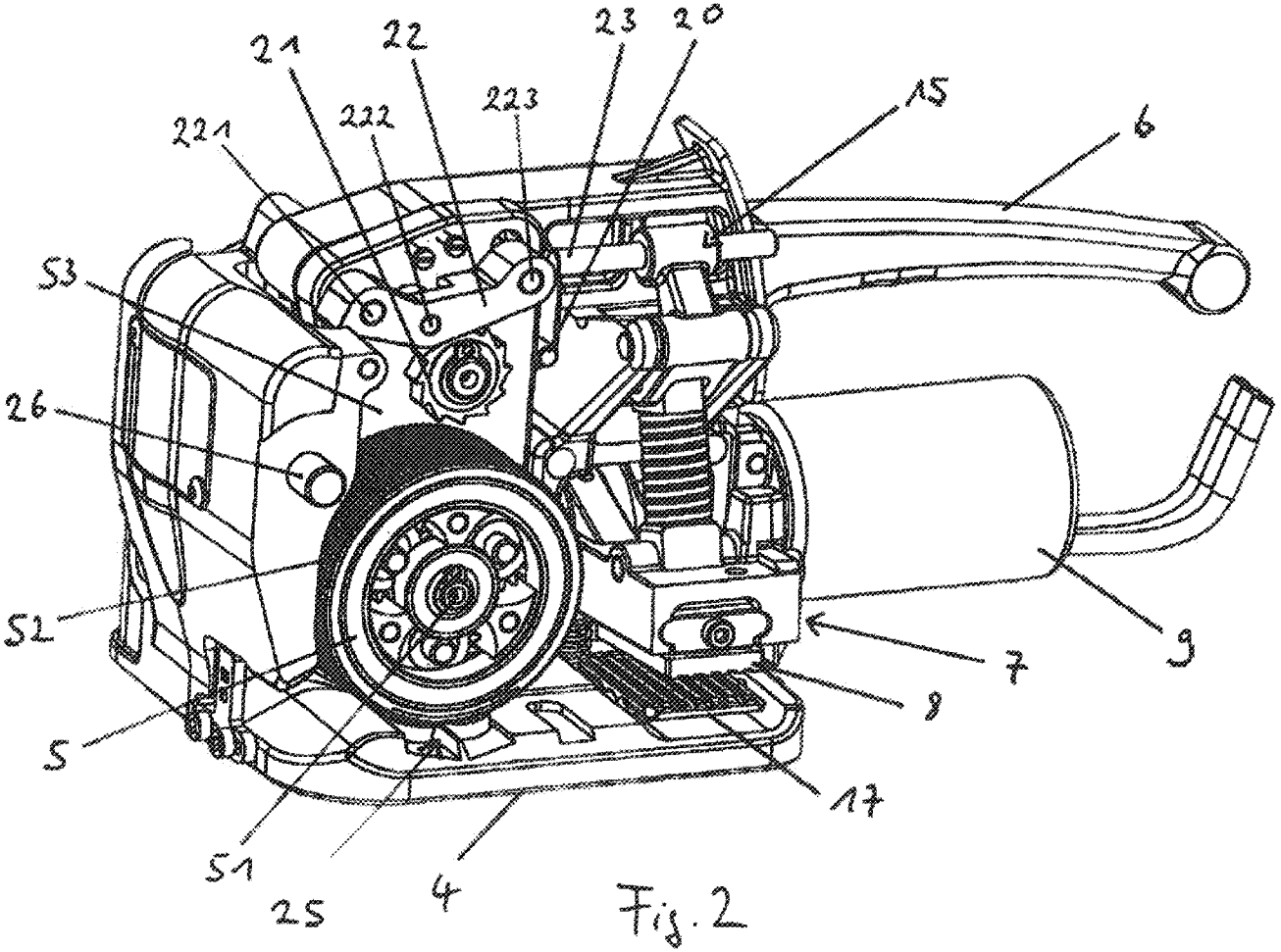
FIG. 2 shows the strapping device of FIG. 1 without the casing.

An overview of the strapping device according to the invention is provided based on FIG. 1 and FIG. 2. FIG. 1 is a perspective view of a mobile strapping device 1 according to the invention. The strapping device 1 shown in FIG. 1 is a hand held tool which comprises a handle 3 for holding the strapping device 1 by a user. A battery 10 is provided at a rear end of the strapping device 1 which forms a chargeable energy storing means. The battery 10 is removable and can be charged in a separate charging device. The strapping device 1 comprises a casing 2 for housing the mechanical and electric components forming the device. The strapping device has a base plate 4 which is substantially flat and forms a bottom surface.

In the area of the handle 3, a lever 6 is provided which forms an operating member which is explained below. On a surface area of the casing 2, in the present embodiment in the front area of the strapping device 1, various operating elements and display elements (101-105) are arranged which are explained below. The strapping device 1 of the present invention is provided for tensioning a loop of a strap by a tensioning mechanism and for connecting two portions of the loop formed by the strap by a welding mechanism.

Figure 15:
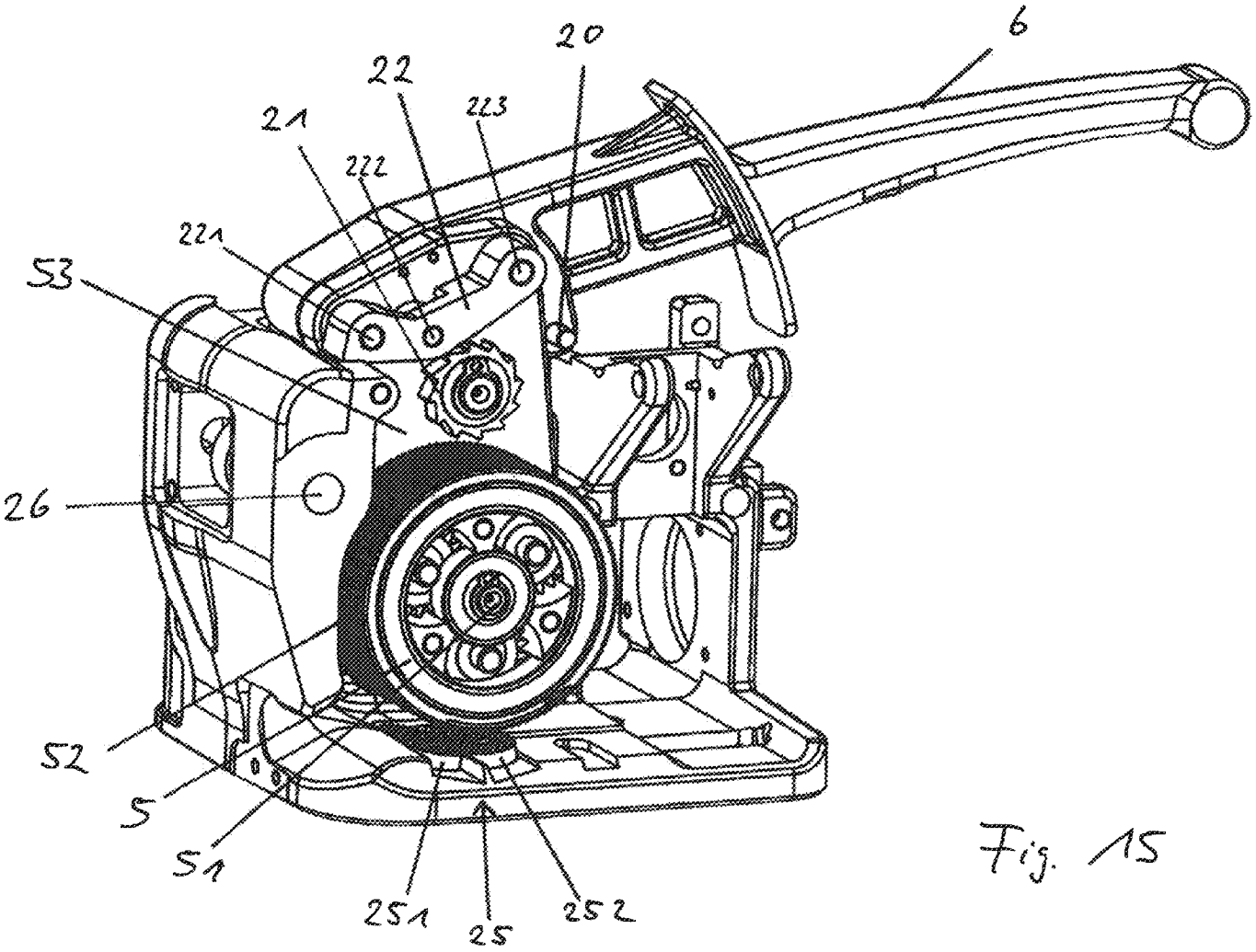
FIG. 15 is a side view of the tensioning mechanism in an open position within a tool frame.

An overview of the functional elements of the strapping device 1 is provided based on FIG. 2 showing the strapping device 1 of FIG. 1 without the casing 2. Further, FIG. 15 shows details of the tensioning mechanism according to the invention.

The tensioning mechanism according to the present invention includes a rotatable tensioning wheel 5 and a stationary tensioning element 25. The tensioning element includes two tensioning plates 251, 252, which are shown in FIG. 15. The tensioning wheel 5 has a circumferential surface 52 which is substantially cylindrical in shape. Further, the tensioning wheel 5 has a rotational axis 51 which is centred with respect to the circumferential surface 52 of the tensioning wheel 5. The tensioning wheel 5 is rotatably supported about the rotational axis 51 on a tensioning wheel support element 53. As shown in FIG. 2, tensioning plates forming the tensioning element 25 are arranged below the tensioning wheel 5. Surfaces of the tensioning element 25 face towards the outer circumferential surface 52 of the tensioning wheel 5. An adjustable gap is formed between the outer circumferential surface 52 of the tensioning wheel 5 and the surfaces of the tensioning element 25 facing towards the outer circumferential surface 52 of the tensioning wheel 5. The arrangement for adjusting the space or distance between the outer circumferential surface 52 of the tensioning wheel 5 and the surfaces of the tensioning element 25 forms the basic concept of the invention as explained below.

As shown in FIG. 2, the strapping device 1 comprises a welding mechanism 7. The welding mechanism includes a stationary welding shoe 17 and an oscillating welding shoe 8. The oscillating welding shoe 8 is oscillatingly drivable by a drive mechanism (explained below) in order to exhibit an oscillating movement with respect to the stationary welding shoe 17. Moreover, a space between the stationary welding shoe 17 and the oscillating welding shoe 8 is adjustable to be closed or opened by a toggle mechanism 15.

Construction and Basic Operation of the Tensioning Mechanism

In the following, the specific mechanic arrangement of the strapping device 1 according to the invention is explained based FIGS. 3-15. The main function of the strapping device 1 according to the invention is applying a tension to a loop of a strap which is used for strapping packaged goods. According to a known technology, the tension is applied to a loop of the strap by overlapping two portions of the strap forming the loop and moving one of the portions of the strap with respect to the other. This movement is achieved by arranging the overlapped or layered portions of the strap forming the loop in a gap between the outer circumferential surface 52 of the tensioning wheel 5 and the surfaces of the tensioning element 25. According to a known technology, the gap is closed in order to apply a pressure to the layered portions of the strap forming the loop. In such a pressed condition, the tensioning wheel is rotatably driven in order to move the portion of the strap which is in contact with the outer circumferential surface 52 of the wheel with respect to the portion of the strap which is in contact with the stationary tensioning element 25.

Figure 4:
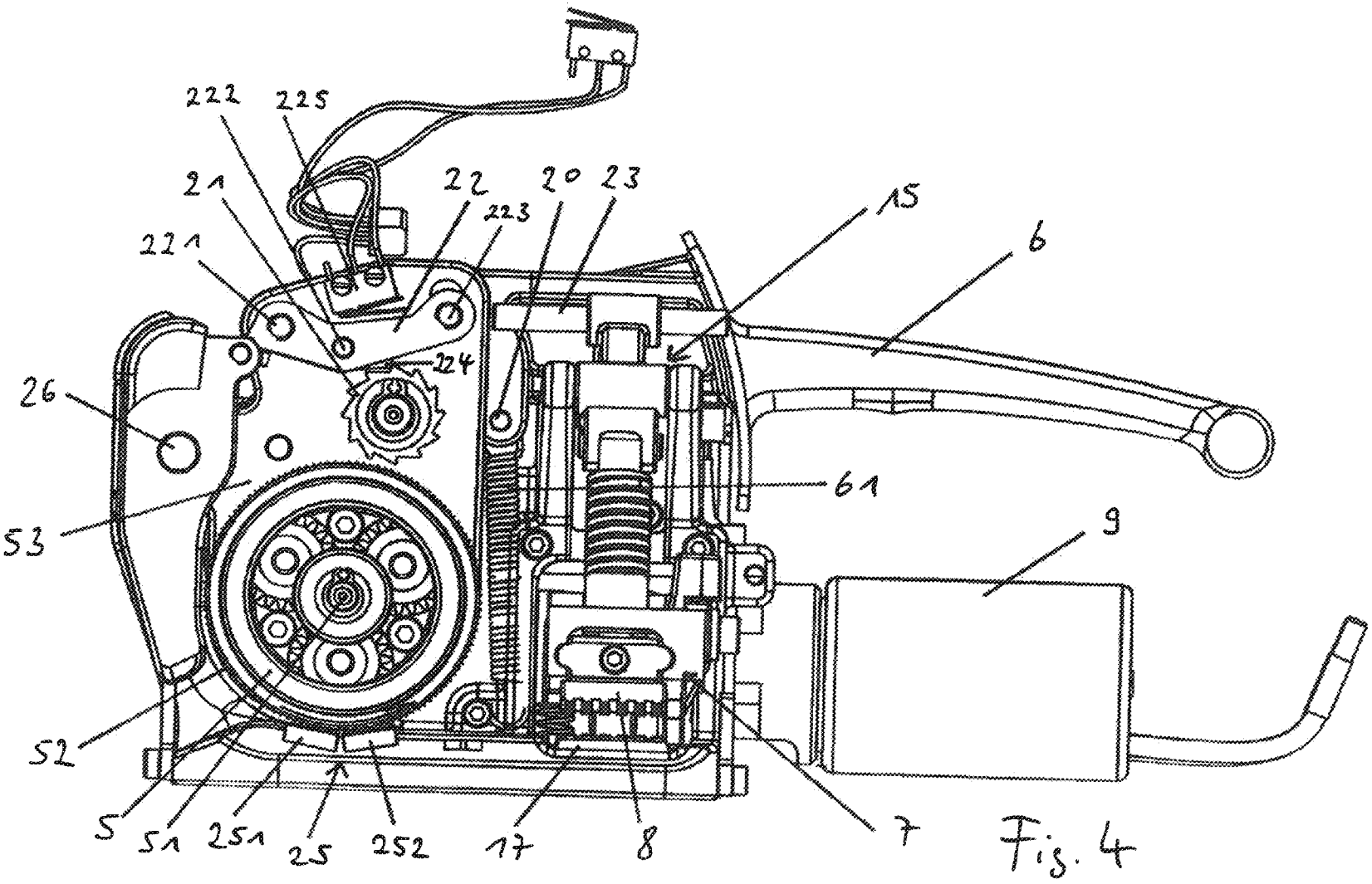
FIG. 4 is a side view of the strapping device without the casing in a situation where the operating lever is in a working position and the welding mechanism is in a rest position (tensioning phase)
Figure 5:
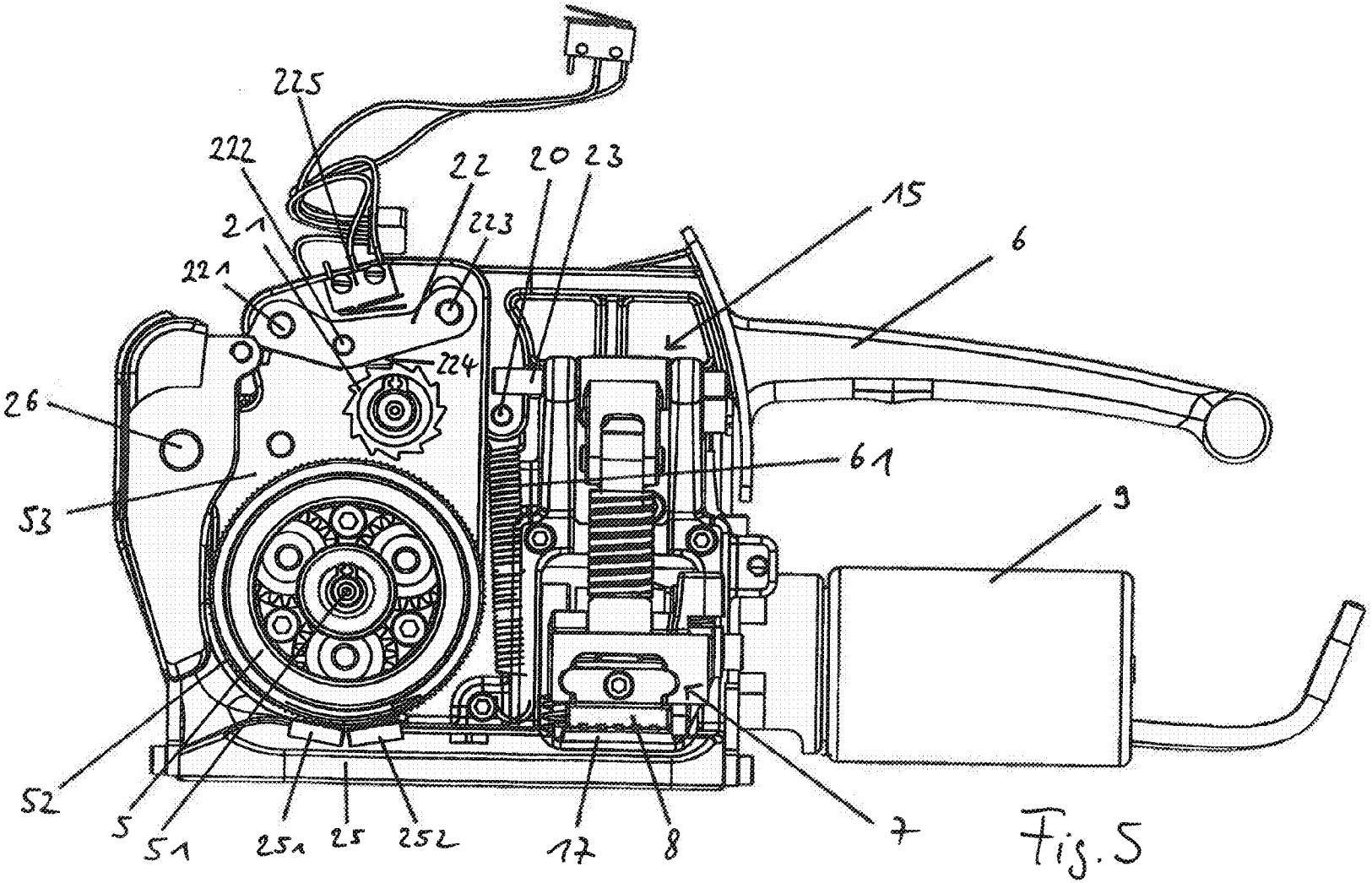
FIG. 5 is a side view of the strapping device without the casing in a situation where the operating lever is in a working position and the welding mechanism is a welding position (welding phase)

According to the basic concept of the present invention, the tensioning element 25 is stationary, while the tensioning wheel 5 is movable with respect to the tensioning element 25. The movable arrangement of the tensioning wheel 5 is explained based on FIGS. 4-6. FIG. 4 shows the tensioning wheel 5 which is supported rotatably about the rotational axis 51. Further, the tensioning element 25 is formed by two tensioning plates 251, 252. The tensioning wheel 5 is supported at a tensioning wheel support element 53 which is formed as plate element in the present embodiment. The tensioning wheel support element 53 is pivotably supported at the main body of the strapping device about a pivot pin forming a pivot axis 26. In FIG. 4, the outer circumferential surface 52 of the tensioning wheel 5 approaches the surfaces of the tensioning plates 251, 252. In this situation, the gap between the tensioning wheel 5 and the tensioning plates 251, 252 is closed. This situation is formed if the lever 6 is not operated by the user due to the force of a spring 61 which pulls the lever 6 to the position shown in FIG. 4. Based on a cooperation of the lever 6 with the tensioning wheel support element 53 via a pivot element 22, the tensioning wheel support element 53 is maintained in the position shown in FIG. 4. The lever 6 is hinged to tensioning wheel support element 53 via pivot element 221 shown in FIG. 4. A pin 223 is inserted in the pivot element 22 connecting ratchet protrusion 224 to lever 6. The pin 223 passes through a slot in the element 53. In this way when lever 6 is lifted, first 7° of rotation are used to disengage the ratchet protrusion 224 form the ratchet wheel 21 and consequently the tensioning wheel 5 becomes able to rotate freely clockwise, thus releasing the retained tension. When pin 223 reaches the upper slot edge, it lifts all the support element 53 and tensioning wheel group allowing for tool extraction from the strap loop. It is noted that FIG. 5 shows the same position of the tensioning mechanism, whereas the position of the welding mechanism differs.

Figure 6:
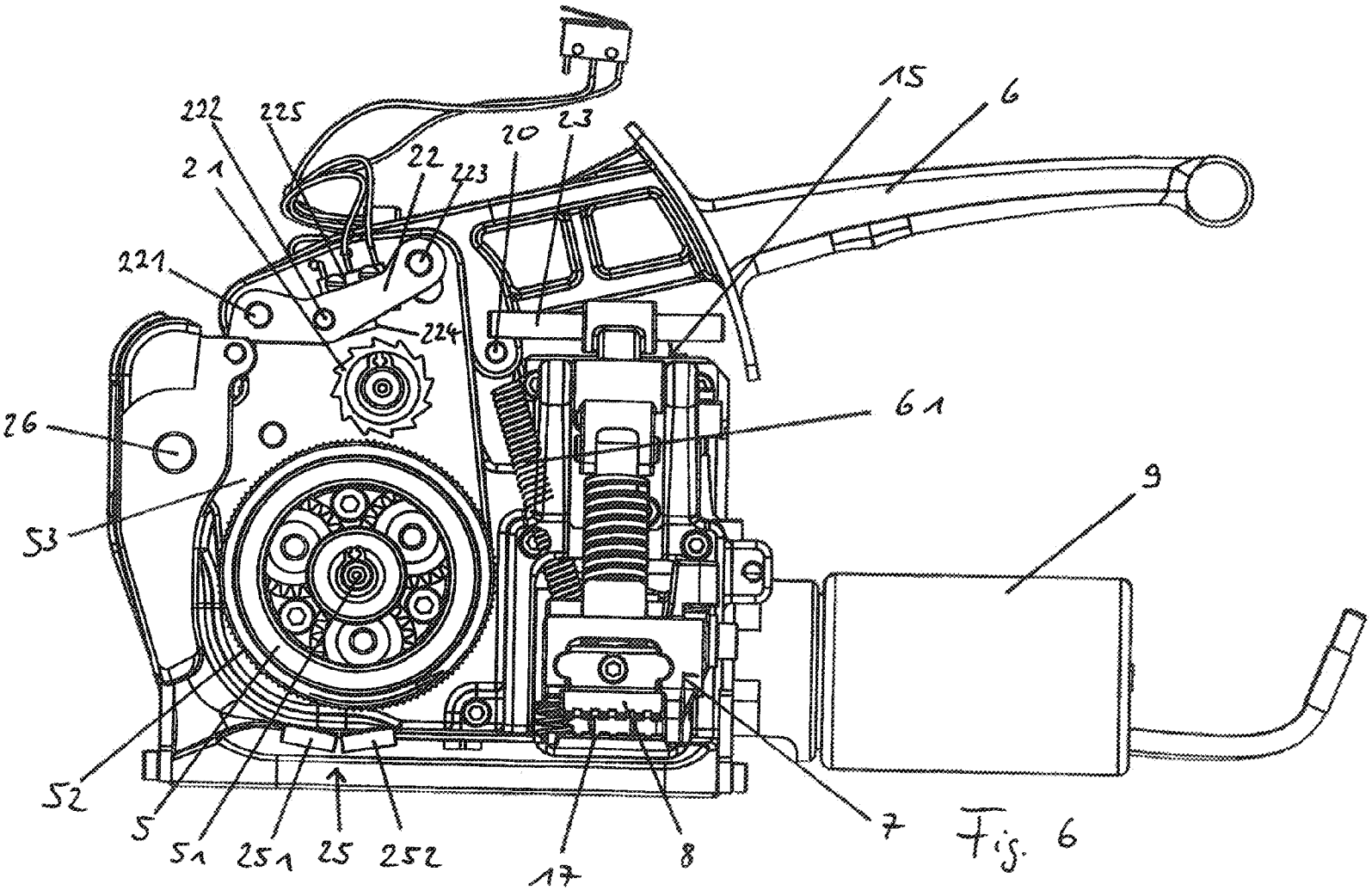
FIG. 6 is a side view of the strapping device without the casing in a situation where the operating lever is an opening position and the welding mechanism is in a rest position (strap loop charging)

In the situation of FIG. 6, the open position of the strapping device 1 is shown. Opening the strapping device 1, in particular, the gap between the outer circumferential surface 52 of the tensioning wheel 5 and the surfaces of the tensioning plates 251, 252 is achieved by operating, i.e. lifting the lever 6 about the tilting axis of the lever 6. In FIG. 6, the lever 6 is lifted such that the pivot element 22 engages the tensioning wheel support element 53 and applies a moment to the tensioning support element 53 for pivoting the tensioning wheel support element 53 about the pivot axis 26 in the counter clockwise direction. Due to the specific relationship between the pivot axis 26 and the rotational axis 51 of the tensioning wheel 5 as well as the position of the tensioning plates 251, 252, the outer circumferential surface 52 of the tensioning wheel is spaced from the surfaces of the tensioning plates 251, 252. This situation can be maintained by manually holding the lever 6 in the lifted position. Releasing the lever 6 will lead to a tilting movement of the lever 6 to the position shown in FIG. 4, which in turn, leads to a pivoting movement of the tensioning wheel support element 53 in the clockwise direction.

According to the basic concept of the present invention, the tensioning wheel 5 is rotatably drivable about the rotational axis 51 and pivotable about the pivot axis 26, wherein the pivot axis 26 is parallel to and offset from the rotational axes 51 of the tensioning wheel 5. As a consequence, opening and closing of the gap between the tensioning wheel 5 and the tensioning plates 251, 252 is possible by pivoting the tensioning wheel support element 53 which can be achieved by operating the lever 6.

The main advantages of this arrangement will become clearer based on a detailed explanation of further elements of the strapping device 1 of the present invention and the operation thereof.

In order to explain the basic operation for tensioning the strap with the strapping device 1 according to the present invention, reference is made to FIG. 6. As explained above, FIG. 6 shows the strapping device 1 in the opened condition. This opened condition is achieved by lifting the lever 6 against the force the force of the spring 61. By lifting the lever 6, the tensioning wheel support element 53 is pivoted in the counter clockwise direction about the pivot axis 26. In the present embodiment, the pivot angle from the closed condition to the opened condition of the strapping device 1 can be set to 30 degrees. However, this is not limiting and the pivot angle can be appropriately set as long as the gap between the tensioning wheel 5 and the tensioning plates 251, 251 is large enough in order to insert layered portions of a strap forming a loop.

In the situation shown in FIG. 6, layered portions of the strap forming a loop are inserted into the gap between the tensioning wheel 5 and the tensioning plates 251, 252. For closing the gap between the tensioning wheel 5 and the tensioning plates 251, 252, the lever 6 is released by the user having the effect that the spring 61 pulls the lever downwards in FIG. 6, achieving a condition shown in FIG. 4. In this situation, the pivot element 22 cooperates with the tensioning wheel support element 53 in order to pivot the tensioning wheel support element 53 in the clockwise direction about the pivot axis 26. This pivot movement of the tensioning wheel support element 53 is achieved by linking the spring to the lever 6 which acts on the tensioning wheel support element 53 via pin 223 provided in the pivot element 22. The pivot element 22 provides a decoupling between the pivoting movement of the tensioning wheel support element 53 and the lever 6 as the pivot element 22 is coupled to the lever 6 and movably supported at the tensioning wheel support element 53 within a specified range which is formed by the slit in which the pin 223 is movable. The overlapped portions of the strap forming a loop are sandwiched between the outer circumferential surface 52 of the tensioning wheel 5 and the surfaces of the tensioning plates 251, 252. The material of the strap used in such applications is commonly plastics such as PET, PP or the like. The frictional coefficient between the surfaces of the layered straps which are in contact is usually very low. In contrast, the outer circumferential surface 52 of the tensioning wheel 5 as well as the surfaces of the tensioning plates 251, 252 are provided with a property which leads to a high frictional coefficient when in contact with the surfaces of the strap. Such a property can be achieved by providing a roughness in the surface or by forming the surfaces with a knurling or a serration.

In the condition shown in FIG. 4, the tensioning wheel 5 is rotated about the rotational axis 51 in the counter clockwise direction. Due to the initial pressure created by the spring 61 in cooperation with the pin 223 of the pivot element 22, the portion of the strap on top of the lower portion of the strap is moved or transported in the longitudinal direction of the strap. Consequently, the length of the loop is decreased by rotating the tensioning wheel 5 in the counter clockwise direction. By decreasing the length of the loop of the strap, the tension in the loop increases. Due to the increase of the tension in the loop of the strap, the force transmitted from the outer circumferential surface 52 of the tensioning wheel 5 to the strap increases. The tension in the loop increases when its length approaches the packaged good perimeter and speed and torque continuous monitoring makes the tool able to detect this condition increasing motor power progressively to the requested torque.

The force which is transmitted from the tensioning wheel 5 to the strap creates a counterforce which is born by the rotational axes 51 of the tensioning wheel 5. As discussed above, this rotational axis 51 is supported by the tensioning wheel support element 53 and produces a moment in the tensioning wheel support member 53 in the clockwise direction about the pivot axis 26.

Due to the arrangement as discussed above, the circumferential surface 52 of the tensioning wheel 5 is pressed against the strap disposed in the gap between the tensioning wheel 5 and the tensioning plates 251, 252 without any further action by the user, in particular without applying a force or operating the lever 6. In particular, the tensioning wheel 5 is pressed against the strap in the gap between tensioning wheel 5 and the tensioning plates 251, 252 with an increased force upon an increase of the tension generated in the loop formed by the strap. Due to the fact that the strap made generally of plastics is decreased in thickness by applying a tension to the strap, the gap between the tensioning wheel 5 and the tensioning plates 251, 252 must be changed in view of this changing thickness of the strap. With the arrangement according to the present invention, this change is performed automatically as the tensioning wheel 5 is pulled towards the strap by the moment generated by the counterforce produced by the force applied from the tensioning wheel 5 to the strap.

Construction and Basic Operation of the Welding Mechanism

The strapping tool 1 according to the present invention includes the welding mechanism which is explained below based on the drawing. As shown in FIG. 2, the welding mechanism 7 is arranged in the body of the strapping device 1 in the rear side of the tensioning wheel 5 with respect to the direction in which the tension is applied to the strap by the tensioning wheel 5. The welding mechanism 7 includes a stationary welding shoe 17 and an oscillating welding shoe 8. The oscillating welding shoe 8 is movable with respect to the stationary welding shoe 17. In particular, the stationary welding shoe 17 comprises a structured surface which includes e.g. a plurality of protruding sections in the surface. The oscillating welding shoe 8 is provided with a similar structure in the surface. The surfaces of the stationary welding shoe 17 and the oscillating welding shoe 8 face each other and can be moved with respect to each other in order to provide a closable gap there between. When the gap between the stationary welding shoe 17 and the oscillating welding shoe 8 is open, as shown in FIG. 2, while the tensioning wheel 5 is lifted away from the tensioning plates 251, 252, two portions of the strap forming the loop can be inserted into the gap between the tensioning wheel 5 and the tensioning plates 251, 252 as well as into the gap between the stationary welding shoe 17 and the oscillating welding shoe 8.

Figure 7:
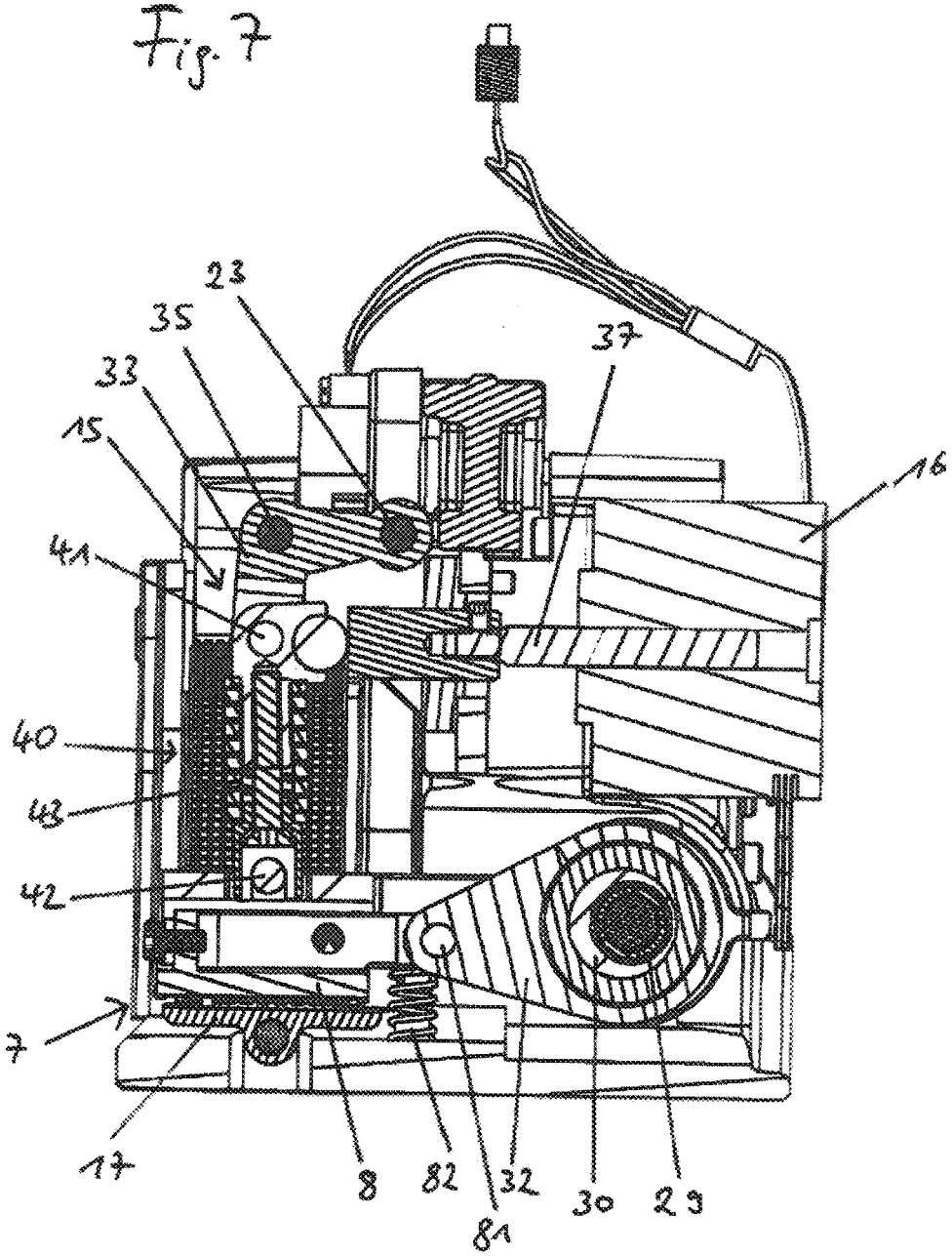
FIG. 7 shows a transversal section of the drive train with the welding mechanism being in the locked position.
Figure 8:
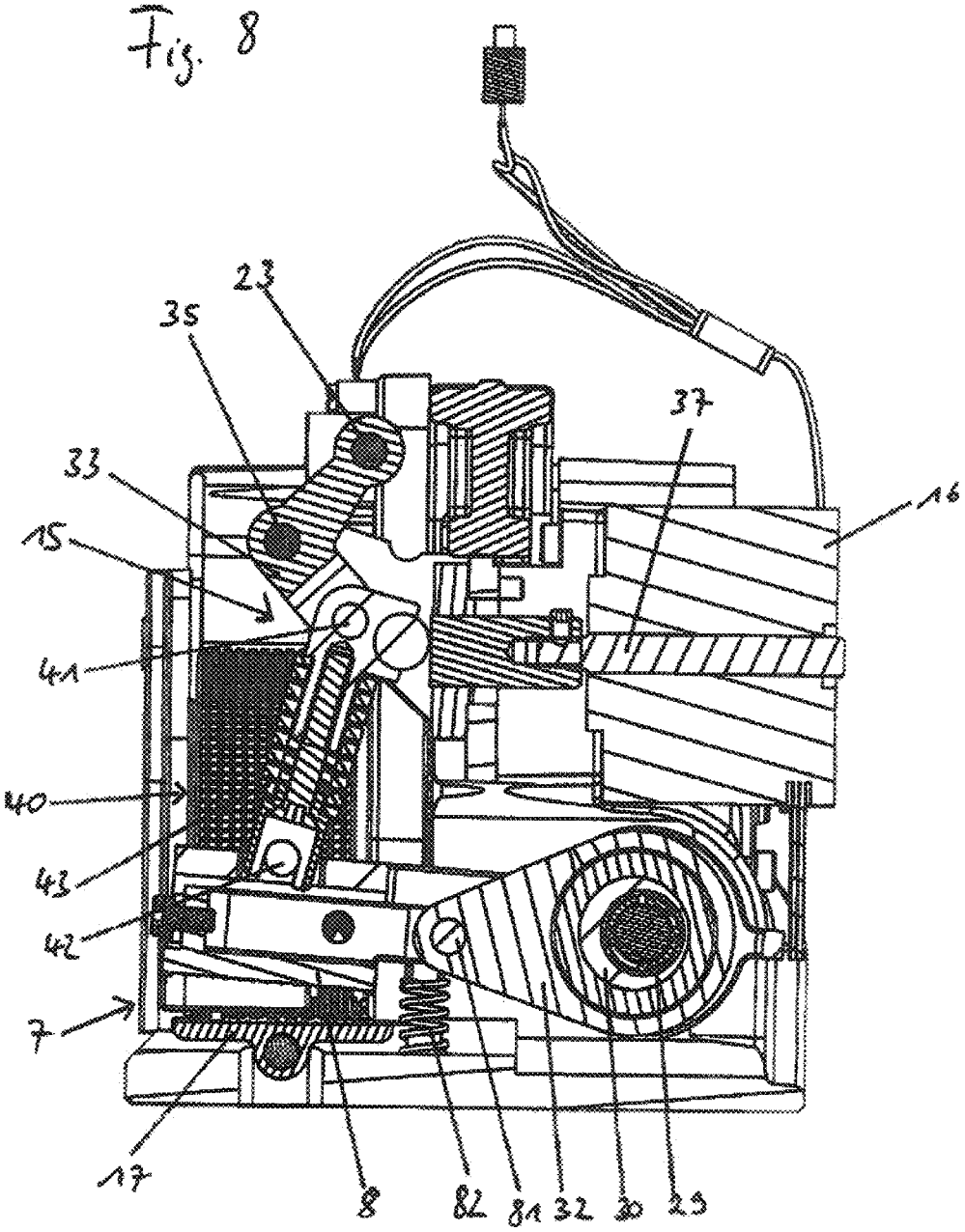
FIG. 8 shows a transversal section of the drive train with the welding mechanism being in the rest position.
Figure 9:
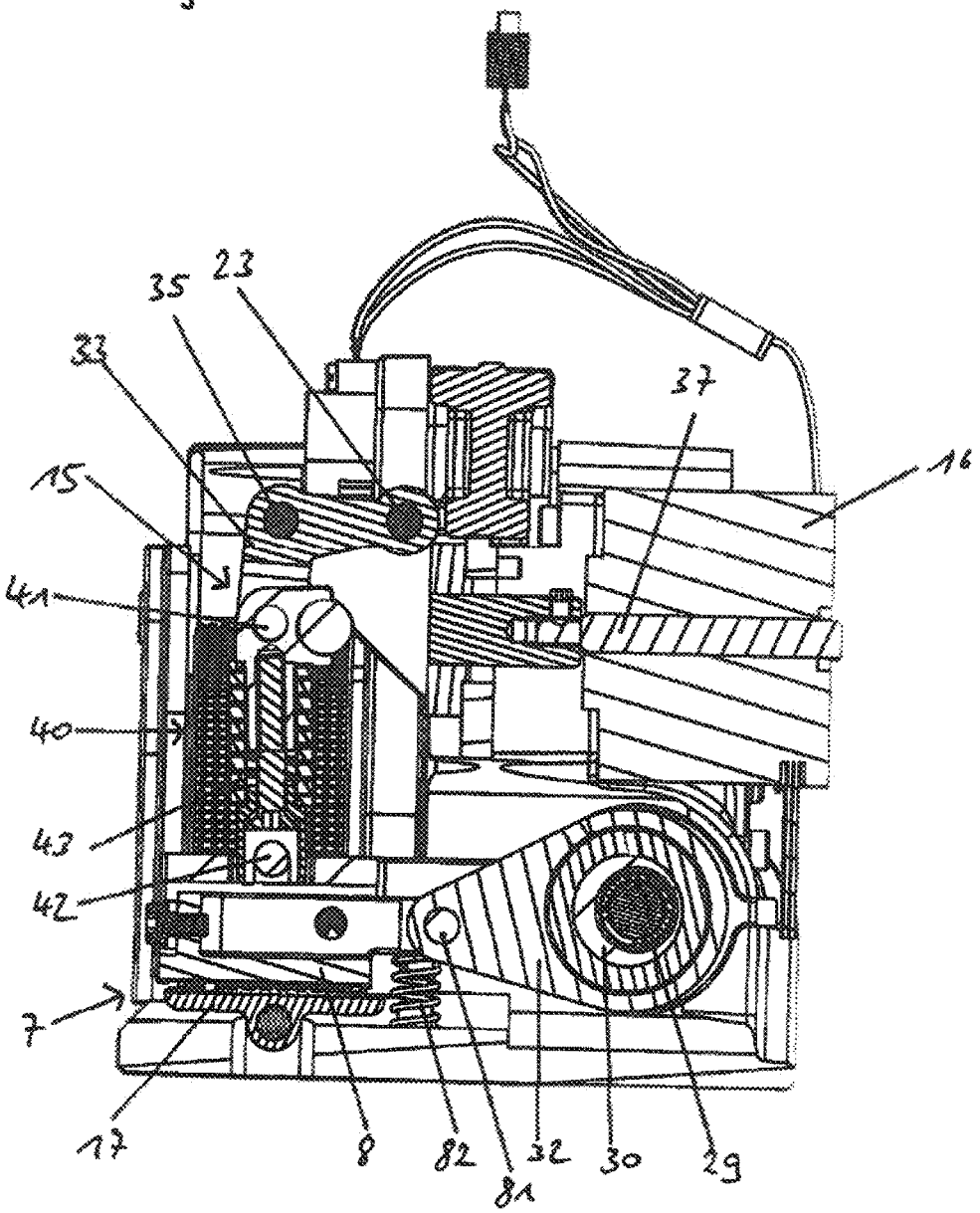
FIG. 9 shows a transversal section of the drive train with the welding mechanism being in the unlocked position.

The situation, in which the portions of the strap forming the loop can be inserted into the gap between the tensioning wheel 5 and the tensioning plates 251, 252 as well as into the gap between the stationary welding shoe 17 and the oscillating welding shoe 8 is shown in FIG. 6. Details of the welding mechanism 7 are shown in FIGS. 7-9. In FIG. 7 the gap between the stationary wording shoe 17 and the oscillating welding shoe 8 is shown in a closed condition. The relative movements between the oscillating welding shoe 8 and the stationary welding shoe 17 is achieved by a toggle mechanism 15. The toggle mechanism 15 includes a toggle lever 33, which is pivotably mounted on a toggle axis 35. The toggle lever 33 is connected on one side thereof to a pushing member 40 via a pin 41 which provides a tiltable link between the toggle lever 33 and the pushing member 40. The pushing member 40 is preloaded by a spring 43. The other end of the toggle lever 33 is provided with a release member 23 for releasing the toggle mechanism 15. The pushing member 40 transmits a force from the toggle lever 33 to the oscillating welding shoe 8 via a pin 42. The pushing member 40 provides a pushing force from the toggle lever 33 to the oscillating welding shoe through said spring 43 in order to lock the toggle mechanism 15 and in order to apply a specified force to oscillating welding shoe 8. The toggle mechanism 15 is remained in the position shown in FIG. 7 due to the slight offset arrangement of the pin 41 with respect to the toggle axis 35.

The strapping device 1 further comprises linear actuator 16 which is equipped with a movable actuator rod 37. The actuator rod 37 presses against the end of the toggle lever 33 which is linked to the pushing member 40 in the situation shown in FIG. 7.

The linear actuator 16 can be an electric actuator which moves the actuator rod 37 towards the position shown in FIG. 7 when energized. However, other actuators are possible as long as the linear actuation of the actuator rod 37 is enabled. As alternative, a rotational actuator can be used which operates the toggle mechanism rotatably.

As shown in FIG. 9, the actuator rod 37 of the linear actuator 16 is retracted and as the toggle lever 33 remains in the position as shown in FIG. 9. However, the toggle lever 33 is only maintained at the position shown in FIG. 9 due to the specific arrangement of the pin 41 and the toggle axes 35 in combination with the force exerted by the spring 43 from the pin 41 to the oscillating welding shoe 8.

When the release member 23 is operated for rotating the toggle lever 33 in the counter clockwise direction in FIG. 9, the pushing member 40 is tilted rightwardly such that the toggle mechanism 15 is released such that the oscillating welding shoe 8 is lifted upwards.

As shown in FIG. 7, the oscillating welding shoe 8 is pivotably connected to a welding shoe arm 32 which is supported on an eccentric bearing 30. The eccentric bearing 30 is supported on a one way bearing 29. The one way bearing 29 is supported on a shaft 28 which is explained below. The shaft 28 is rotatable in two directions, wherein the rotation of the shaft 28 is transmitted to the eccentric bearing 30 only in one direction, whereas no rotation is transmitted from the shaft to the eccentric bearing 30 in the other direction. Due to the eccentric arrangement of the eccentric bearing 30, an oscillating movement is generated in the welding shoe arm 32 which is transmitted to the oscillating welding shoe 8.

The welding shoe arm 32 is pivotably connected to the oscillating welding shoe 8 via a pin 81. In the area of the connection of the oscillating welding shoe 8 and the welding shoe arm 32, a spring 82 is provided which supports the oscillating welding shoe 8 to the body of the strapping device 1 in an elastic manner.

As consequence of this arrangement, the gap between the oscillating welding shoe 8 and the stationary welding shoe 17 can be closed by actuating the actuator 16 by pushing one end of the toggle lever 33 by the actuator rod 37. That is, by actuating actuator 16, the situation of FIG. 8 is changed over to the situation of FIG. 7, in which the gap between the oscillating welding shoe 8 and the stationary welding shoe 17 is closed and a specific pressure in this gap is generated by the spring 43 of the pushing member 40. The situation shown in FIG. 7 is a locked position as the toggle lever 33 is locked by the actuator rod 37.

Due to the specific arrangement of the toggle mechanism 15, as discussed above, the toggle mechanism 15 is maintained in the position shown in FIG. 9. This situation is called the unlocked situation as the toggle mechanism 15 can be placed in the open condition by slightly lifting the release member 23. By this action, the open condition of the toggle mechanism 15 is achieved as shown in FIG. 8. The linear actuator 16 moves forward and retracts immediately after leaving the toggle mechanism locked mechanically in order to avoid vibration transmission to the actuator during following welding phase. The toggle mechanism is disengaged only mechanically by the lever 6 its pin 20.

The welding function of the welding mechanism 7 is achieved by rotating the shaft 28 in the direction in which the one way bearing 29 transmits a rotation to the eccentric bearing 30. Due to this eccentric arrangement of the eccentric bearing 30, the welding shoe arm 32 performs an oscillating movement which is transmitted to the oscillating welding shoe 8 while the stationary welding shoe 17 is not moved. When the portions of the strap forming a loop are placed on top of each other in the gap between the oscillating welding shoe 8 and the stationary welding shoe 17 and the toggle mechanism 15 is operated in order to close the gap and exert a specific pressure to the layered portions of the strap forming the loop, the oscillating movement of the oscillating welding shoe 8 with respect the stationary welding shoe 17 produces friction heat in the layered portions of the strap such that parts of the material of the strap melt and form a connection after cooling down. The operational time of the oscillating mechanism is predetermined in order to make sure that a sufficient amount of material of the portions of the strap melts and merges such that after cooling down the portions of the strap, a connection between the portions of the strap is created which can only be opened by cutting or applying a very high tension to the loop formed by the strap.

Drive Mechanism of the Strapping Device

Figure 3:
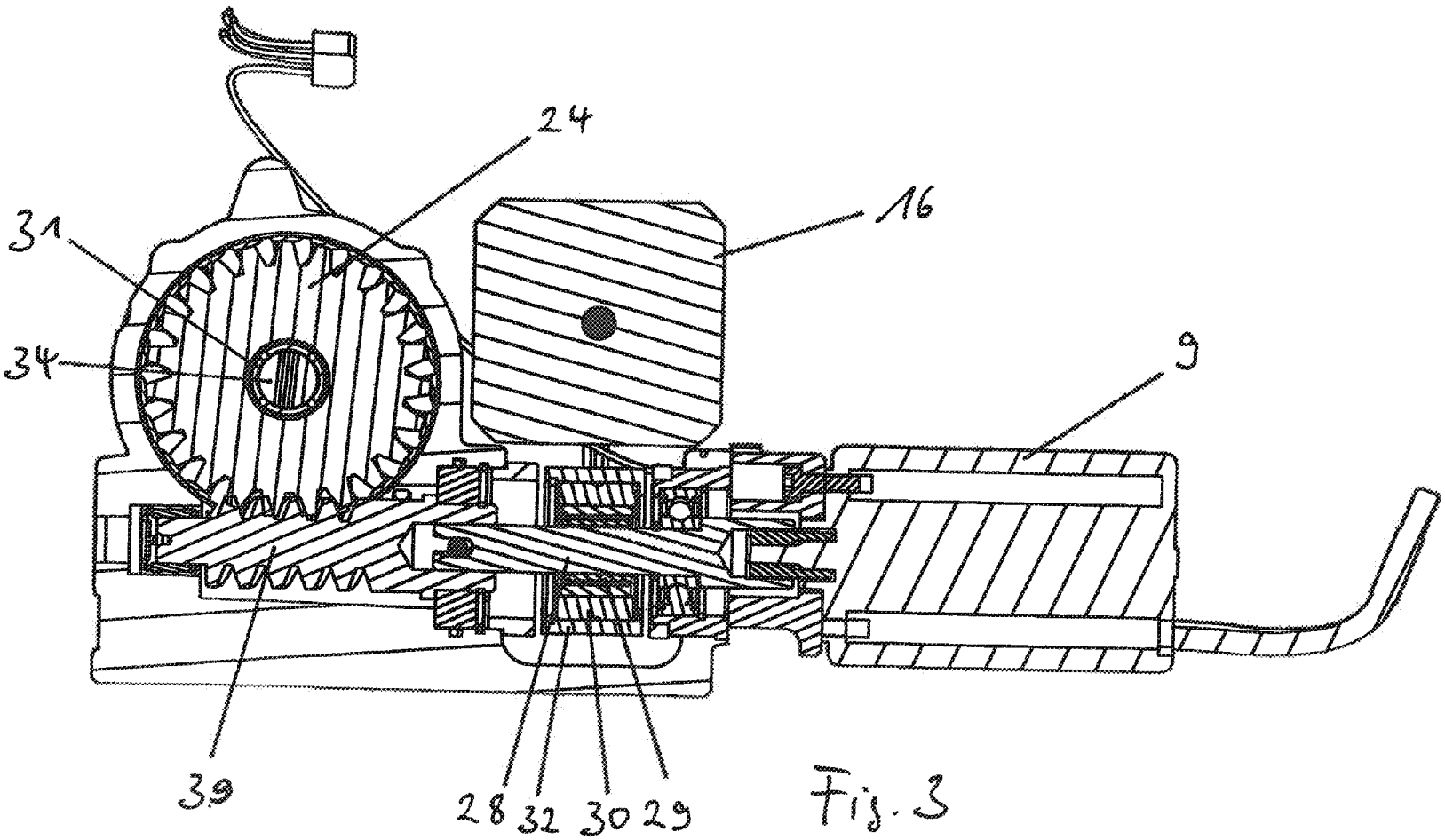
FIG. 3 is a sectional view of a part of a drive train of the strapping device of FIG. 1.

According to the concept of the present invention, the tensioning mechanism and the welding mechanism use the same drive source in the form of an electric motor 9. The drive mechanism is shown in FIG. 3 in detail. FIG. 3 shows the electric motor 9 having an output shaft which carries a worm shaft 39 at the end. Between the worm shaft 39 and the electric motor 9, a shaft portion 28 is provided. On the outer circumference of the shaft portion 28, the eccentric bearing 30 is provided with the one way bearing 29 being arranged there between. As discussed above, the welding shoe arm 32 is provided on the outer circumference of the eccentric bearing 30 in order to perform the oscillating movement when the shaft portion 28 rotates in one direction which is defined as oscillating direction. When the shaft portion 28 is rotated in the other direction, no rotation is transmitted to the eccentric bearing 30 such that welding shoe arm 32 is not oscillated.

The worm shaft 39 meshes with a worm gear 24 such that the rotation of the electric motor 9 is transmitted to the worm gear 24 with a reduced transmission ratio. The gear 24 is supported on a rotatable shaft via a one way bearing 31. The one way bearing 31 is arranged in order to transmit the rotation of the worm gear 24 to the shaft only in one direction whereas no rotation is transmitted from the worm gear 24 to the shaft supporting the one way bearing 31 in the other direction. That is, one rotational direction of the electric motor 9 is defined as oscillating direction for driving the welding mechanism, whereas the other rotational direction of the electric motor 9 is defined as tensioning direction for driving the tensioning mechanism. The drive mechanism shown in FIG. 3 is mounted in the device frame as shown in FIG. 2. The strapping device 1 without the drive mechanism is shown in FIG. 15.

Figure 10:
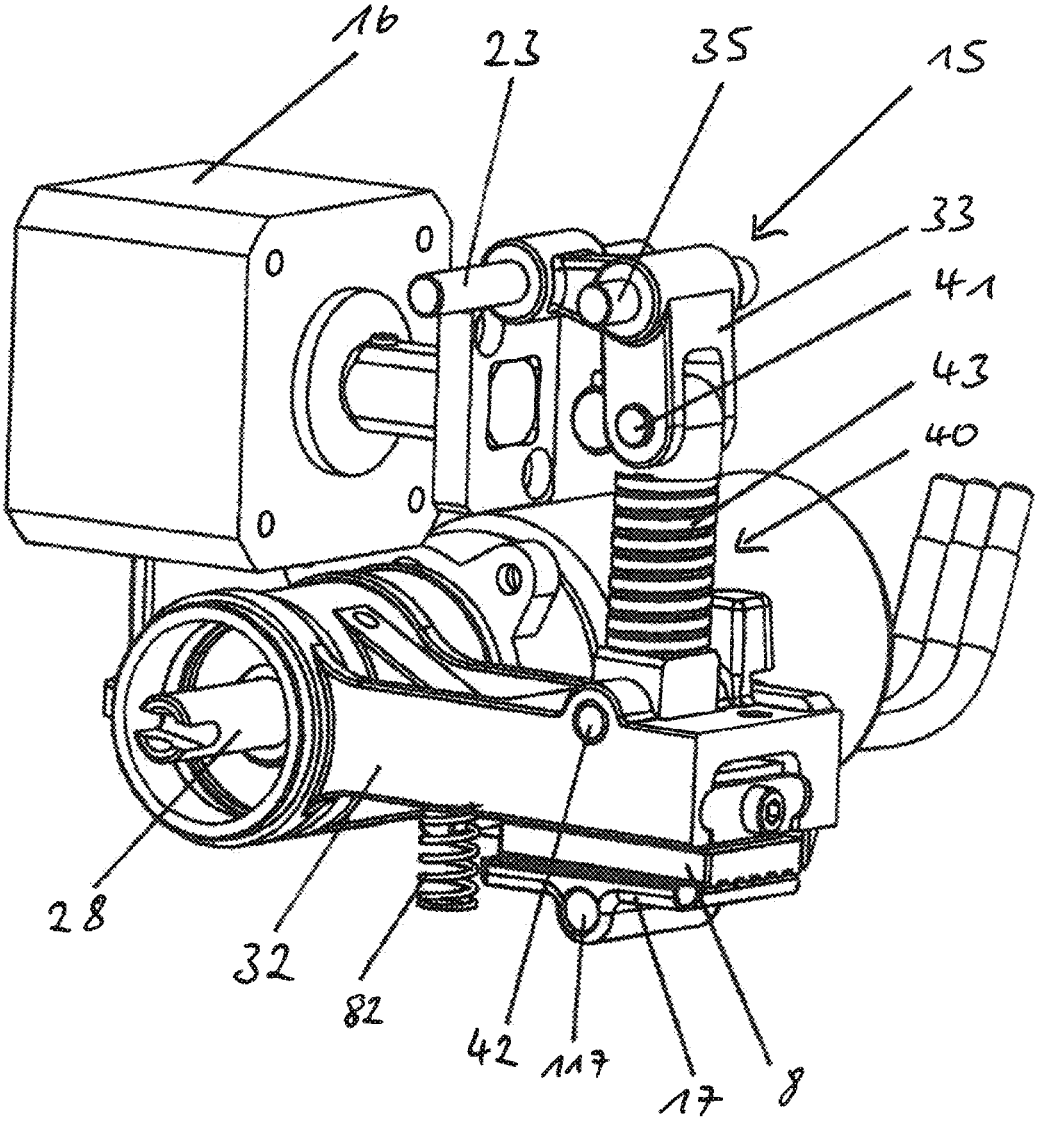
FIG. 10 is a side view of the welding mechanism with a toggle mechanism being in an unlocked position.
Figure 11:
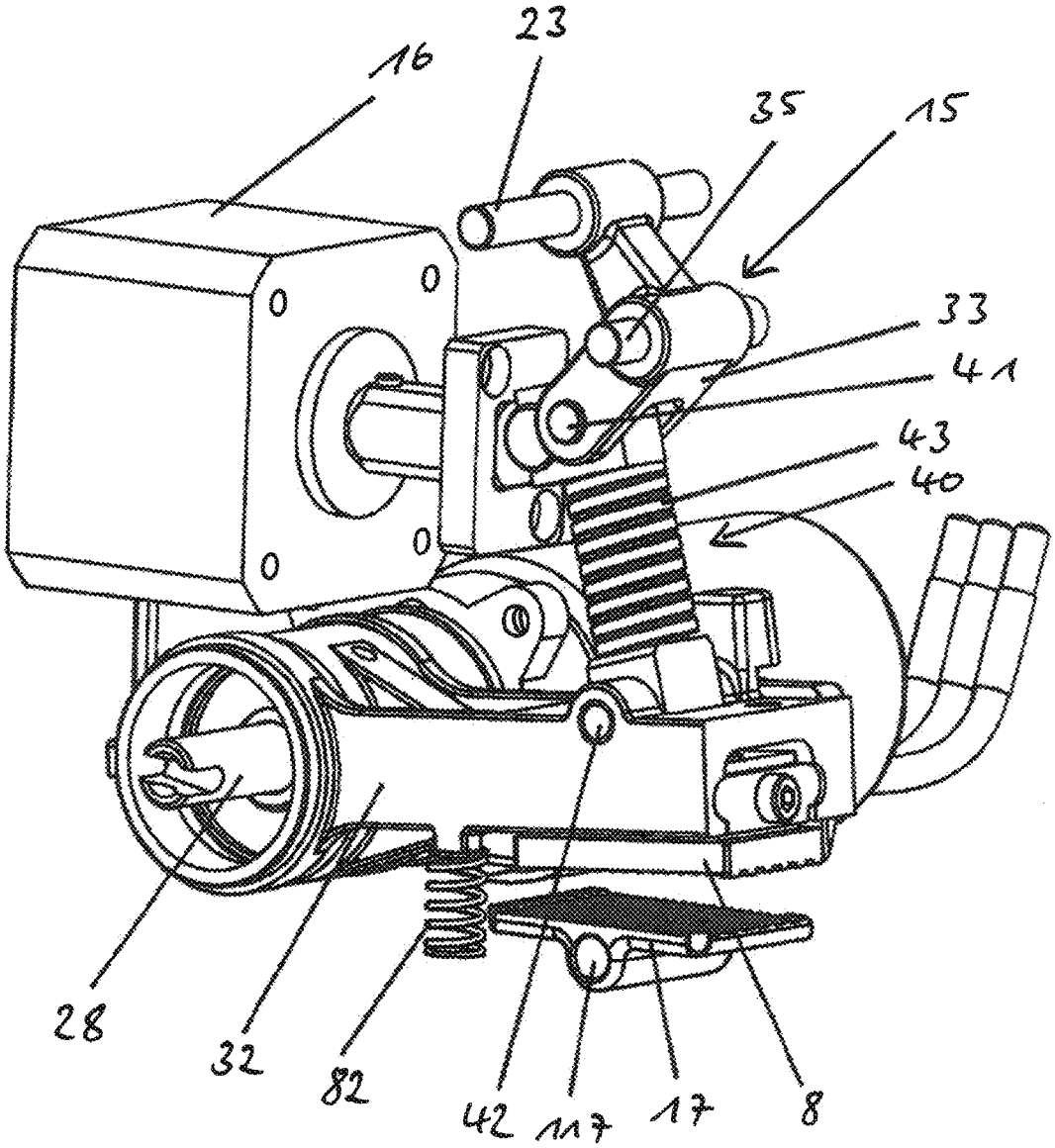
FIG. 11 is a side view of the welding mechanism with the toggle mechanism being in a rest position.

In summary, the drive mechanism shown in FIG. 3 transmits the rotation of the shaft portion 28 to the eccentric bearing 30 only when rotating in one direction, whereas the rotation of the electric motor is transmitted to the shaft supporting the worm gear 24 via the one way bearing 31 is only transmitted when rotating in the other direction. The electric motor can be preferably a DC brushless motor which can be operated by supplying DC wherein the rotational direction of the electric motor 9 can be reversed by reversing the polarity of the current supply to the motor. The relation between the drive mechanism for the welding mechanism 7 and the tensioning mechanism is explained based on FIGS. 10-12. As shown in FIG. 10, the toggle mechanism 15 is shown in the closed condition. In FIG. 11, the toggle mechanism 15 is shown in the opened condition. As can be derived from the drawings, the shaft portion 28 protrudes from the group including the oscillating mechanism for driving the welding mechanism. This shaft portion 28 is provided for driving the worm 39 shown in FIG. 3. It follows, that the strapping device 1 according to the present invention only requires a single electric motor 9 for driving both the welding mechanism and the tensioning mechanism wherein the selection of the drive is made by selecting the rotational direction of the electric motor 9 such that the drive is selectively applied to the welding mechanism or to the tensioning mechanism.

Figure 12:
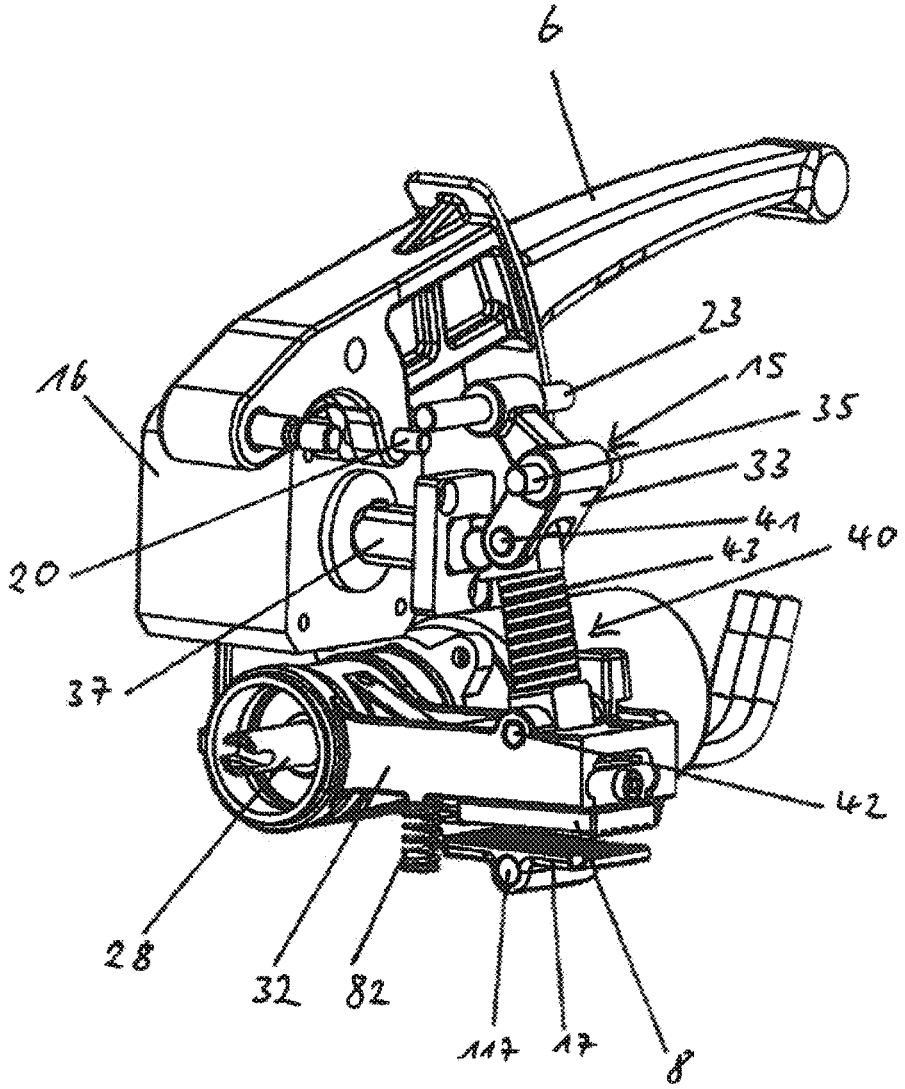
FIG. 12 is a side view of the welding mechanism together with the operation lever in an intermediate position when the lever is disengaging the toggle mechanism.

FIG. 12 shows the group including the oscillating mechanism with lever 6. As discussed above, the lever 6 is provided for changing the pivotal position of the tensioning wheel support member 53 as shown and discussed based on FIGS. 4-6. The additional function of the lever 6 is the manual actuating operation of the toggle mechanism 15 by a releasing protrusion 20 shown in FIG. 12. That is by pulling the lever 6, the releasing protrusion 20 engages with the release member 23 of the toggle mechanism 15 in order to rotate the toggle lever 33 in the counter clockwise direction in FIG. 7. Based on this operation, the toggle mechanism 15 is released such that the gap between the oscillating welding shoe 8 and the stationary welding shoe 17 is opened.

Overall Operation of the Strapping Device

In the following, the overall operation of the strapping device is explained.

In the situation shown in FIG. 6, the tensioning wheel 5 is spaced from the tensioning plates 251, 252 and the gap between the oscillating welding shoe 8 and the stationary welding shoe 17 is open. In this situation, two layered portions of the strap forming the loop can be inserted into these gaps. In this situation, lever 6 is pulled upwards against the force of the spring 61. Based on the action of the release protrusion 20 and the release member 23 of the toggle mechanism 15, the toggle mechanism can be released when the linear actuator 16 is de-energized. This mechanism is designed to be operated in any instant, as tool emergency stop; when lever 6 is lifted the micro switch 225 is pressed stopping motor and ratchet protrusion 224 becomes disengaged allowing tensioning wheel to rotate freely clockwise releasing strap tension if not welded.

When the portions of the strap forming the loop are inserted in said gaps, the lever 6 can be released, which is automatically moved downwards by the action of the spring 61. At the same time, the pivot element 22 shown in FIG. 6 is moved downwards to a position shown in FIG. 5. The ratchet protrusion 224 of the pivot element 22 engages with the ratchet wheel 21 which is rotated together with the drive train with the tensioning wheel 5. The ratchet protrusion 224 is pivotable around pin 222 and elastically maintained in position by a torsion spring.

When the lever 6 is released, the micro switch 225 is actuated in order to drive the electric motor 9 in the direction for transmitting the drive to the tensioning wheel 5, that is, in the tensioning direction. Upon releasing the lever 6, the tensioning wheel support element 53 is tilted in the clockwise direction about the pivot axes 26 such that the outer circumferential surface of the tensioning wheel 5 is moved towards the portions of the strap forming a loop which is pressed between the tensioning wheel 5 and the tensioning plates 251, 252. At the same time, the tensioning wheel 5 is rotated in the counter clockwise direction in FIG. 5 such that the portion of the strap which is in contact with the outer circumference of the tensioning wheel 5 is moved in the longitudinal direction of the strap such that a tension is applied to the loop. In this situation, the toggle mechanism 15 of the welding mechanism remains in the opened condition.

The control mechanism obtains information on the tension applied to the loop which is in the present embodiment based on the current supplied to the electric motor while the tensioning wheel 5 is driven. When the current exceeds a predetermine value, it is determined that the tension has reached the predetermined value as well. In the process of applying the tension to the loop, the pressure of the tensioning wheel 5 to the layered strap, and, in turn, to the tensioning plates 251, 252 is increased due to the counterforce applied to the tensioning wheel support element 53 as discussed above. That is, a decrease in thickness of the strap is automatically adjusted by pivoting the tensioning wheel support element 53 due to the increased counter force applied from the tensioning wheel 5 to the tensioning wheel support element 53.

When the predetermined tension is determined by the control unit of the strapping device 1, the rotation of the electric motor 9 is stopped and reversed subsequently or immediately reversed to the opposite rotational direction such that no rotation is transmitted to the tensioning wheel but to the welding mechanism as discussed above. At the same time, the linear actuator 16 is energized in order to lock the toggle mechanism 15 in order to achieve the position shown in FIG. 5. In this situation, the toggle mechanism provides a pressing force to the portions of the strap forming the loop which is sandwiched between the oscillating welding shoe 8 and the stationary welding shoe 17.

Based on the reverse of the rotational direction of the electric motor (9) to the oscillating direction, the eccentric bearing 30 is rotated and the welding shoe arm 32 performs an oscillating movement which is transmitted to the oscillating welding shoe 8.

Friction heat is generated in the layered portions of the strap forming the loop such that the connection by melting the material of the strap can be performed. After a predetermined time, the electric motor 9 is stopped such that the oscillating movement of the oscillating welding shoe 8 is terminated. When this situation has been reached, the lever 6 can be lifted from the position shown in FIG. 5 to the position shown in FIG. 6. It is noted that the lever 6 can be lifted in any instant interrupting tool working cycle and is not necessary the drive or any part of mechanical transmission is in a specific position. By lifting lever 6, the toggle mechanism 15 is released in order to open the gap between the oscillating welding shoe 8 and the stationary welding shoe 17. The portions present in the gap between the oscillating welding shoe 8 and the stationary welding shoe 17 are connected after cooling down the material. Remaining sections of the strap which are not part of the loop can be cut by a cutting means which is not shown in the drawings.

After this process, the loop which is formed by the connected and tensioned strap can be released from the strapping device 1 and the operation is finished.

The control of the strapping device 1 is performed by a control unit (not shown) which is provided for controlling the operation of the electric motor 9, the actuation of the linear actuator 16 taking into account the position of the lever 6 and further information such as the current supplied to the electric motor 9. Operating modes can be set by a switch button 103, which is shown in FIG. 1. The operating modes provide selective functions of the operating switch 102. In the first mode by operating the operating switch 102, without further action being required by an operator, the tensioning mechanism and the welding mechanism are started up consecutively and automatically. To set the second mode, the switch button 103 is switched over to a second switching mode. In the second possible operating mode, by operating the operating switch 102, only the tensioning mechanism is started up. To separately start the friction mechanism, another operating switch 101 is to be actuated after the device stops after completing the tensioning procedure.

The third mode is a type of semi-automatic operation in which the operating switch 102 must be pressed until the tensioning force which can be preset in stages is achieved in the strap. In this mode it is possible to interrupt the tensioning process by releasing the operating switch 102 for example in order to position edge protectors on the goods to be strapped under the wrapping strap. By pressing the operating switch 102, the tensioning procedure can then be continued.

The above described procedures of tensioning and welding can be jointly initiated in one switching status of the operating switch 102 and can be mechanically interrupted and disengaged in any position and time by means of the lever 6.

The strap tension to be applied to the strap can be set on the strapping device by means of a pushed button in a predetermined number of stages. The strapping device 1 comprises a display 105 which displays the selected strap tension besides others. Moreover, an indicator 104 is provided for indicating the status of the strapping device 1.

Figure 13:
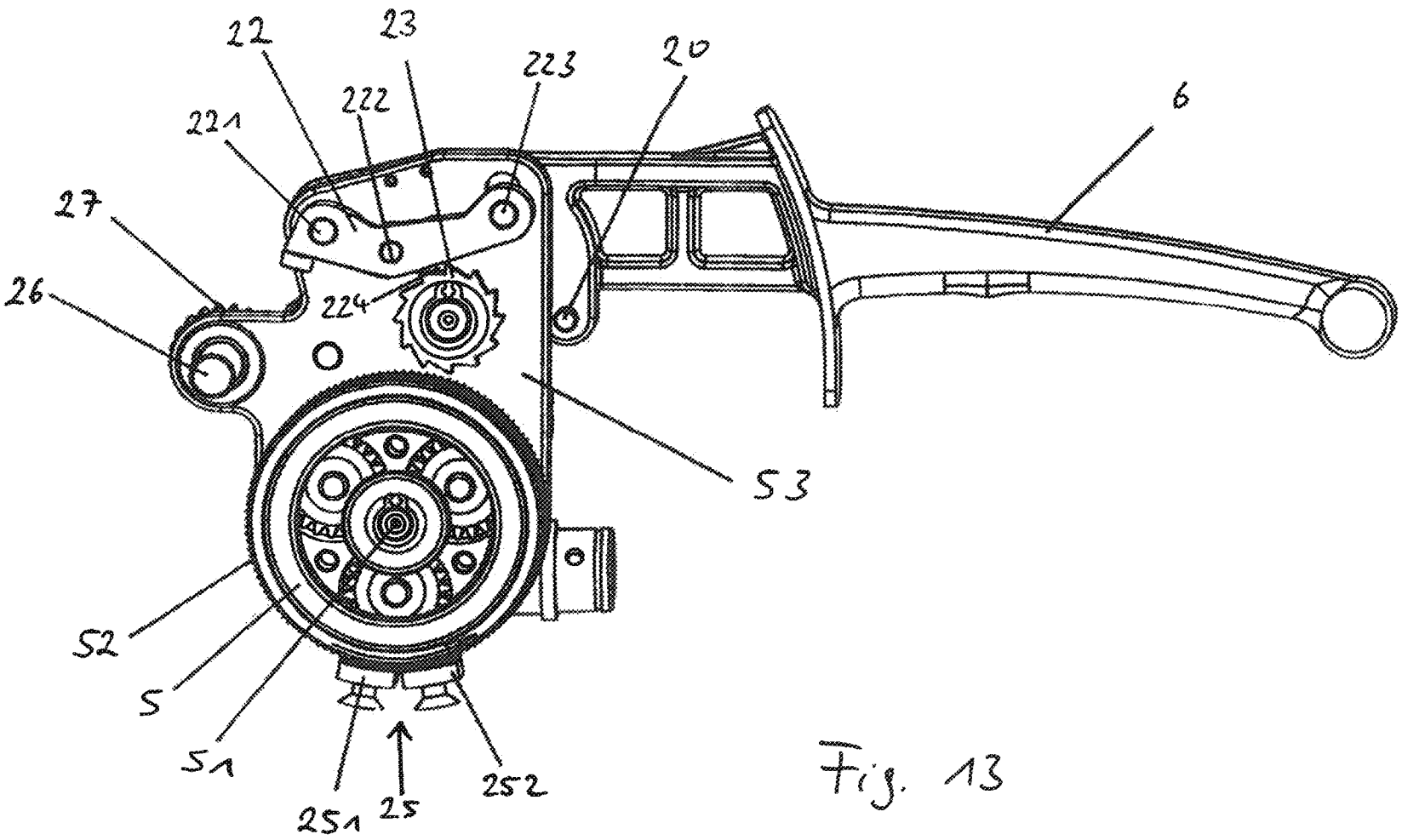
FIG. 13 is a side view of parts of the tensioning mechanism in a closed position.
Figure 14:
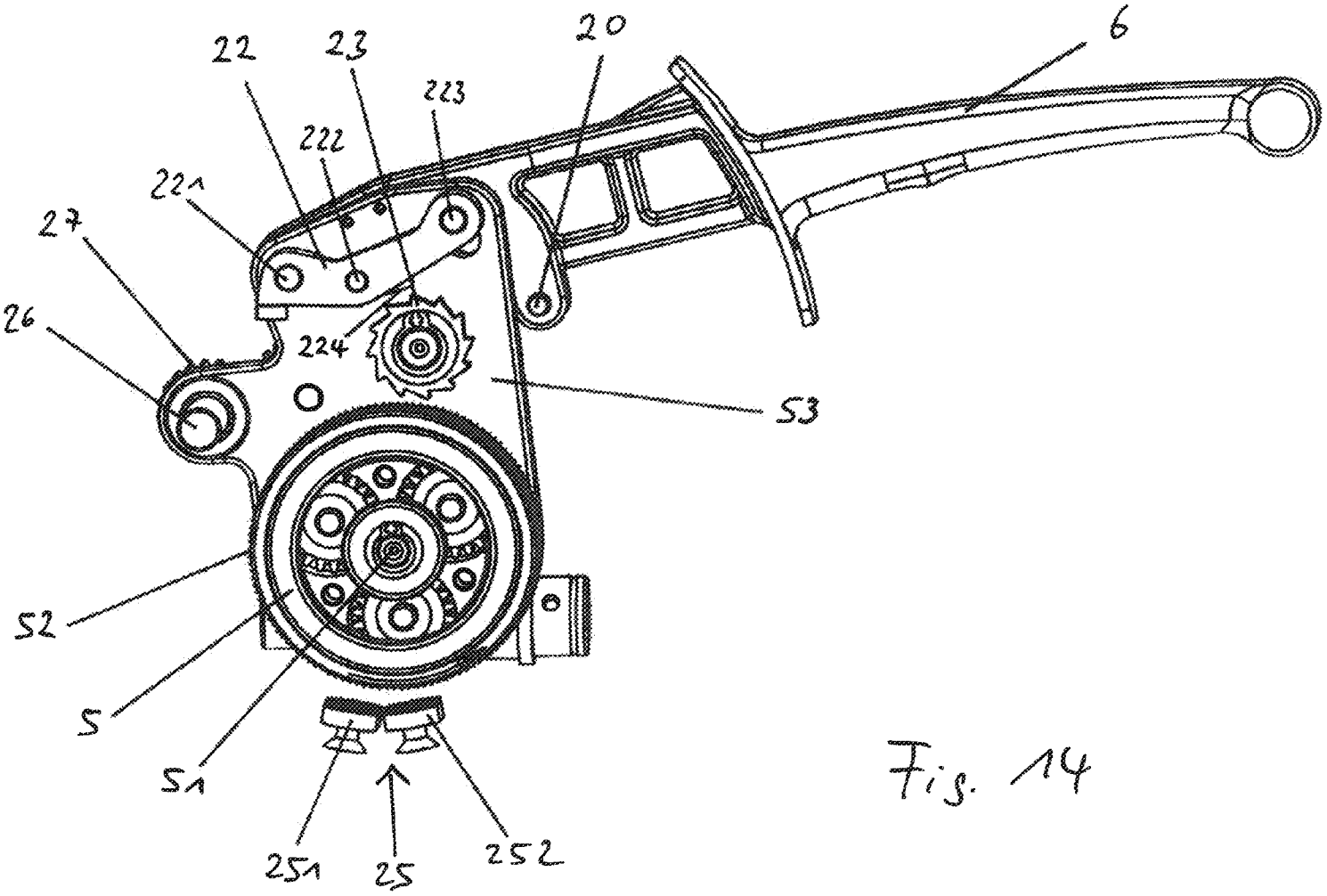
FIG. 14 is a side view of parts of the tensioning mechanism in an open position.

When the predetermined current supplied to the motor is detected by the control unit, the motor is stopped or the rotational direction thereof is reversed in order to stop the transmission of rotation to the tensioning wheel 5. The protrusion of the pivot element 22 is in engagement with the ratchet wheel 21 shown in FIG. 4. A gear train for transmitting the rotation from the worm gear 24 shown in FIG. 3 to the tensioning wheel 5 is provided on the backside of the tensioning wheel support member 53. The gear train is not essential for the invention and it is only required that the tensioning wheel support member 53 is pivotable about the pivot axes 26 while the rotation can be transmitted from the worm wheel 24 to the tensioning wheel 5. As consequence, it is preferable to provide at least one gear which is rotatable about the pivot axes 26. Such a gear is shown in FIG. 13 on the backside of the tensioning wheel support member 53 and is indicated which reference sign 27. When the tensioning wheel 5 applies a tension to the strap, the rotational direction is the counter-clockwise direction in FIG. 14. The ratchet wheel 21 which is in engagement with the gear train on the backside of the tensioning wheel support member 53 rotates in the clockwise direction such that the tension applied to the strap by the tensioning wheel 5 is maintained by stopping the reverse direction of the wretched wheel 21 by engaging with the ratchet protrusion 224 of the pivot member 22, as shown in FIG. 4.

The tensioning plates 251, 252 of the tensioning element 25 are shown as two elements having a flat surface. In a modification, it is possible to form the tensioning element as single element, wherein it is further preferable to provide the tensioning element with a surface which faces towards the outer circumferential surface of the tensioning wheel 5 which is concavely curved with a similar curvature as the tensioning wheel such that the dimension of the gap between the tensioning wheel 5 and the tensioning element is substantially constant. However, in a further modification, it is possible to arrange a single tensioning element which is flat, as long as the dimension of the gap between the tensioning wheel and the tensioning element is changeable by pivoting the tensioning wheel support member about the pivot axes 26.

The tensioning plates 251, 252 are shown as flat plates. However, it is possible to provide the plates with a curvature which basically is adapted to the curvature of the tensioning wheel 5 taking into account the thickness of the strap to be positioned in the gap.

The solution according to the invention exhibits advantages to a particular extent in the case of small packaged goods approximately 750 mm edge length or less) as well as round packaged goods (diameter approx. 500-1000 mm) in connection with high tensile forces. In these conditions the then comparatively small strap loop had resulted in shock-like stressing of the lower strap layer, i.e. the strap end, through which the lower strap layer is pulled against the tensioning plate. Due to very different conditions over the entire length of the tensioning plate, securing holding of the strap end in the strapping device could not guarantee in previous solutions. The movable tensioning wheel exhibits decisive advantages here, which are essentially seen in the fact that even at shock like tensile stresses in connection with high tensile forces, the straps can be held by the toothed plate and tensioning wheel surface which are optimally arranged because of the mobility of the pressing tensioning wheel.

The sensor-less brushless direct current motor 9, shown purely schematically in FIG. 3, is designed with a rotor with permanent magnets. The central electronic control determines during rotation the current position of the rotor and provides electronic commutation in the stator. The phases (phase 1, phase 2, phase 3) can thus be controlled depending on the position of the shaft portion 28 in order to bring about a rotational movement of the rotor in a particular rotational direction with a predeterminable variable rotational speed and torque. In this present case a "1$^{st}$ quadrant motor drive intensifier" is used, which provides the motor with the voltage as well as peak and continuous current and regulates these. The current flow for coil windings of the stator, which are not shown in more detail, is controlled via a bridge circuit (MOSFET transistors), i.e. commutated. A temperature sensor which is not shown in more detail is also provided on the motor. In this way the rotational direction, rotational speed, current limitation and motor temperature can be monitored and controlled. The commutator is designed as an integrated section of main device electronic control and managed by a microprocessor separately from the motor.

The power supply is provided by the lithium-ion storage battery 10. Such storage batteries are based on several independent lithium ion cells in each of which essentially separate chemical processes take place to generate a potential difference between the two poles of each cell. In the example of embodiment the lithium ion storage battery is manufactured by Sony Energy Devices Corporation, 1-1 Shimosugishita, Takakura, Hiwada-machi, Koriyama-shi, Fukushima, 963-0531 Japan. The battery in the example of embodiment has 2 parallel strings of 5 cells in series and has a capacity of 3.0 Ampere per hour. Graphite is used as the active material, anode of the lithium ion storage battery. The cathode often is lithium metal oxides, more particularly in the form of layered structures. Anhydrous salts, such as lithium hexafluorophospate or polymers are usually used as the electrolyte. The voltage emitted by a conventional lithium ion storage battery is usually 3.6 Volts. The energy density of such storage batteries is around 100 Wh/Kg-120 Wh/Kg.

The invention is not restricted to any dimensions of the strap or the packages to be treated by the strapping device of the invention. Further, materials of elements can be adapted if required.

LIST OF REFERENCE NUMBERS

1 Strapping device
2 Casing
3 Handle
4 Base plate
5 Tensioning wheel
51 Rotational axis
52 Circumferential surface
53 Tensioning wheel support element
6 Operating lever
7 Welding mechanism
8 Oscillating welding shoe
9 Motor
10 Battery
15 Toggle mechanism
16 Linear actuator
17 Stationary welding shoe
20 Releasing protrusion
21 Ratchet wheel
22 Pivot element
221 Pin
222 Pin
223 Pin
224 Ratchet protrusion
225 Micro switch
23 Release member
24 Worm gear
25 Tensioning element
251 Tensioning plates
252 Tensioning plates
27 Gear
29 One way bearing
30 Eccentric bearing
31 One way bearing
32 Welding shoe arm
33 Toggle lever
35 Toggle axis
37 Actuator rod
39 Worm shaft
40 Pushing member
41 Pin

42 Pin
43 Spring
61 Spring
81 Pin
82 Spring
101 Operating switch
102 Operating switch
103 Switch button
104 Indicator
105 Display

The invention claimed is:

1. Mobile strapping device for strapping goods with a strap, comprising:

a tensioning means for applying a tension to a loop of said strap, a connecting means for providing a connection in said strap for forming a closed loop of said strap, a drive means for driving said tensioning means and said connecting means, said tensioning means comprising a tensioning wheel having an outer circumferential surface and being rotatably drivable about its rotational axis by said drive means and a tensioning element having a surface which faces the outer circumferential surface of said tensioning wheel, wherein:

said tensioning wheel is supported rotatably about a rotational axis at a tensioning wheel support element which is in turn pivotably supported at a main body of the strapping device about a pivot pin forming a pivot axis, a distance between said outer circumferential surface of said tensioning wheel and said surface of said tensioning element is variable by pivoting said tensioning wheel, said pivot axis is parallel to and offset from said rotational axis of said tensioning wheel, and a lever is further provided hinged to said tensioning wheel support element via a pivot element, a ratchet protrusion of the pivot element being engageable with a ratchet wheel which is rotated together with a drive train of the tensioning wheel.

2. Mobile strapping device according to claim 1, wherein said outer circumferential surface of said tensioning wheel is pulled to said strap upon applying tension to said loop formed by said strap.

3. Mobile strapping device according to claim 1, wherein the distance between said outer circumferential surface of said tensioning wheel and said surface of said tensioning element is decreased by pivoting said tensioning wheel in a first rotational direction, wherein said tensioning wheel is rotated in a second rotational direction upon applying tension to said loop of said strap, said second rotational direction being opposite to the first rotational direction.

4. Mobile strapping device according to claim 1, wherein the distance between said outer circumferential surface of said tensioning wheel and said surface of said tensioning element is decreased by pivoting said tensioning wheel in a first rotational direction, said strapping device comprising a support element which rotatably and pivotably supports said tensioning wheel, wherein a moment is applied in the first rotational direction to said support element upon applying tension to said loop of said strap and rotatably driving said tensioning wheel in a second rotational direction, said second rotational direction being opposite to the first rotational direction.

5. Mobile strapping device according to claim 1, wherein upon applying tension to said loop of said strap, a pressing force between said outer circumferential surface of said tensioning wheel and said surface of said tensioning element is generated based on said moment in said first rotational direction.

6. Mobile strapping device according to claim 1, wherein upon rotatably driving said tensioning wheel one of said two sections of said strap contacting said outer circumferential surface of said tensioning wheel is moved longitudinally with respect to the other of said two sections of said strap contacting said surface of said tensioning element.

7. Mobile strapping device according to claim 1, further comprising a pivoting mechanism having an operating member, wherein upon operating said operating member, said tensioning wheel is pivotable for moving said outer circumferential surface of said tensioning wheel towards said surface of said tensioning member.

8. Mobile strapping device according to claim 1, wherein said drive means are operated by energy supplied by chargeable energy storage means, and further comprising a control unit obtaining information regarding a tension applied to said strap upon rotating said tensioning wheel, wherein said control unit is arranged for stopping the rotational drive of said tensioning wheel when said information regarding said tension applied to said strap indicates at least a predetermined tension of said strap.

9. Mobile strapping device according to claim 8, wherein said drive means includes an electric motor and wherein said information regarding said tension applied to said strap includes an electric current supplied to said electric motor.

10. Mobile strapping device according to claim 1, wherein said drive means includes a DC electric motor being drivable in two rotational directions.

11. Mobile strapping device according to claim 1, further comprising a drive transmission mechanism transmitting a drive torque of said drive means selectively to said tensioning wheel and to said connecting means depending on a rotational direction of said drive means.

12. Mobile strapping device according to claim 1, wherein said connecting means includes a pressing mechanism pressing two sandwiched portions of said strap by two pressing members, and an oscillating welding mechanism providing a relative oscillating movement of said pressing members generating friction heat in said two sandwiched portions of said strap from friction welding said two portions of said strap.

13. Mobile strapping device according to claim 1, wherein said outer circumferential surface of said tensioning wheel and/or said surface of said tensioning member is provided with friction increasing means adapted to apply a friction to said strap.

14. Mobile strapping device for strapping goods with a strap, comprising:

a tensioning device configured to apply a tension to a loop of said strap;

a connecting device configured to provide a connection in said strap for forming a closed loop of said strap; and a drive device configured to drive said tensioning device and said connecting device, wherein said tensioning device comprises a tensioning wheel having an outer circumferential surface and is rotatably drivable about its rotational axis by said drive device and a tensioning element having a surface which faces the outer circumferential surface of said tensioning wheel, wherein said tensioning wheel is supported rotatably about a rotational axis at a tensioning wheel support element which is in turn pivotably supported at a main body of the strapping device about a pivot pin forming a pivot axis, wherein a distance between said outer circumferential surface of said tensioning wheel and said surface of said tensioning element is variable by pivoting said tensioning wheel, wherein said pivot axis is parallel to and offset from said rotational axis of said tensioning wheel, and wherein a lever is further provided hinged to said tensioning wheel support element via a pivot element, a ratchet protrusion of the pivot element being engageable with a ratchet wheel which is rotated together with a drive train of the tensioning wheel.

15. Mobile strapping device according to claim 14, wherein said outer circumferential surface of said tensioning wheel is pulled to said strap upon applying tension to said loop formed by said strap.

16. Mobile strapping device according to claim 1, wherein tensioning means is arranged for sandwiching and pressing two sections of said strap positioned on top of each other between said outer circumferential surface of said tensioning wheel and said surface of said tensioning element.

17. Mobile strapping device according to claim 14, wherein said tensioning device is arranged for sandwiching and pressing two sections of said strap positioned on top of each other between said outer circumferential surface of said tensioning wheel and said surface of said tensioning element.

18. Mobile strapping device according to claim 14, further including a chargeable energy storage device and wherein the drive device is operated by energy supplied by said chargeable energy storage device.

* * * * *